US009925692B2

(12) United States Patent
LaCroix et al.

(10) Patent No.: US 9,925,692 B2
(45) Date of Patent: Mar. 27, 2018

(54) BLOCK SPLITTER ASSEMBLY AND METHOD OF PRODUCING WALL BLOCKS

(71) Applicants: David M. LaCroix, Eagan, MN (US); Robert John Lundell, Stillwater, MN (US); Robert A. MacDonald, Plymouth, MN (US)

(72) Inventors: David M. LaCroix, Eagan, MN (US); Robert John Lundell, Stillwater, MN (US); Robert A. MacDonald, Plymouth, MN (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 148 days.

(21) Appl. No.: 15/133,479

(22) Filed: Apr. 20, 2016

(65) Prior Publication Data

US 2016/0303763 A1 Oct. 20, 2016

Related U.S. Application Data

(60) Provisional application No. 62/149,981, filed on Apr. 20, 2015.

(51) Int. Cl.
*B28D 1/32* (2006.01)
*E02D 29/02* (2006.01)

(52) U.S. Cl.
CPC ..... *B28D 1/322* (2013.01); *E02D 29/025* (2013.01)

(58) Field of Classification Search
CPC ..... B28D 1/222; B28D 1/223; B28D 1/225; B28D 1/322; B28D 7/04; B24B 53/11; B28B 17/0027
(Continued)

(56) References Cited

U.S. PATENT DOCUMENTS 1,004,193 A 9/1911 Plaisted
2,881,753 A 4/1959 Entz
(Continued)

FOREIGN PATENT DOCUMENTS

EP 0 294 267 A1 12/1988
GB 924290 A 4/1963
(Continued)

OTHER PUBLICATIONS

Sep. 3, 2008 Notification of Transmittal of the International Search Report and the Written Opinion of the International Searching Authority, or the Declaration in International Application No. PCT/US2008/065921 (16 pages).
(Continued)

*Primary Examiner* — George Nguyen
(74) *Attorney, Agent, or Firm* — Popovich, Wiles & O'Connell, P.A.

(57) ABSTRACT

The invention provides a block splitter device comprising first lower and second upper opposed block splitter assemblies. The block splitter assemblies have a centrally located depression extending the length of the assembly and two or more first forming blades. One forming blade is disposed to the right of and one forming blade is disposed to the left of the center depression. The forming blades have forming surfaces with first and second forming edges. The forming surface of the first block splitter assembly is opposed to the forming surface of the second block splitter assembly.

20 Claims, 18 Drawing Sheets

(58) Field of Classification Search
USPC ..... 125/23.01
See application file for complete search history.

(56) References Cited

U.S. PATENT DOCUMENTS

| | | | | |
|---|---|---|---|---|
| 2,925,080 | A | 2/1960 | Smith | |
| 3,392,719 | A | 7/1968 | Clanton et al. | |
| 3,998,201 | A * | 12/1976 | Miura | B28D 1/00 100/231 |
| 4,114,773 | A | 9/1978 | Sekiguchi | |
| 4,250,863 | A | 2/1981 | Gagnon et al. | |
| 6,029,943 | A | 2/2000 | Sievert | |
| 6,050,255 | A * | 4/2000 | Sievert | B28B 17/0018 125/23.01 |
| 6,082,057 | A | 7/2000 | Sievert | |
| 6,178,704 | B1 | 1/2001 | Sievert | |
| 6,321,740 | B1 | 11/2001 | Scherer et al. | |
| 6,827,073 | B1 | 12/2004 | Morrell | |
| 6,874,494 | B2 * | 4/2005 | Scherer | B28B 17/0027 125/23.01 |
| 6,886,551 | B2 | 5/2005 | Scherer et al. | |
| 6,910,474 | B1 | 6/2005 | Scherer | |
| 6,918,715 | B2 | 7/2005 | Scherer et al. | |
| 6,964,272 | B2 | 11/2005 | Scherer | |
| 7,004,158 | B2 | 2/2006 | Scherer et al. | |
| 7,066,167 | B2 | 6/2006 | Scherer et al. | |
| 7,146,974 | B2 | 12/2006 | Scherer | |
| 7,428,900 | B2 | 9/2008 | Scherer | |
| 8,302,591 | B2 | 11/2012 | LaCroix | |
| 8,448,634 | B2 | 5/2013 | LaCroix | |
| 8,701,647 | B2 | 4/2014 | LaCroix | |
| 8,701,648 | B2 | 4/2014 | LaCroix | |
| 2003/0089363 | A1 | 5/2003 | Suto et al. | |
| 2004/0200468 | A1 * | 10/2004 | Scherer | B28B 17/0027 125/23.01 |
| 2005/0268901 | A1 | 12/2005 | Scherer | |
| 2006/0027226 | A1 | 2/2006 | Sorheim | |
| 2006/0054154 | A1 | 3/2006 | Scherer | |
| 2006/0169270 | A1 | 8/2006 | Scherer et al. | |
| 2008/0047539 | A1 | 2/2008 | Scherer et al. | |
| 2008/0092870 | A1 | 4/2008 | Karau et al. | |
| 2008/0096471 | A1 | 4/2008 | Karau et al. | |
| 2008/0135035 | A1 | 6/2008 | Scherer | |
| 2008/0302350 | A1 * | 12/2008 | LaCroix | B28B 17/0027 125/23.01 |
| 2014/0090632 | A1 | 4/2014 | LaCroix | |

FOREIGN PATENT DOCUMENTS

| | | | |
|---|---|---|---|
| GB | 1 509 747 | A | 5/1978 |
| WO | WO 2004/091879 | A1 | 10/2004 |

OTHER PUBLICATIONS

Abstract for EP 0 294 267 A1 (2 pages).

* cited by examiner

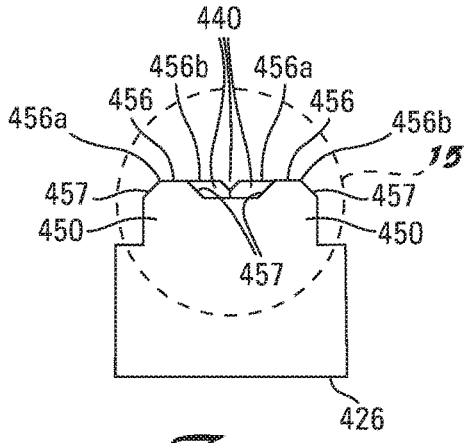
Fig. 14
Fig. 15
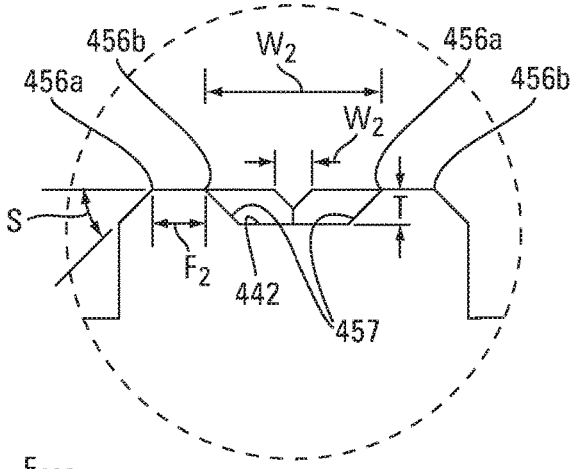
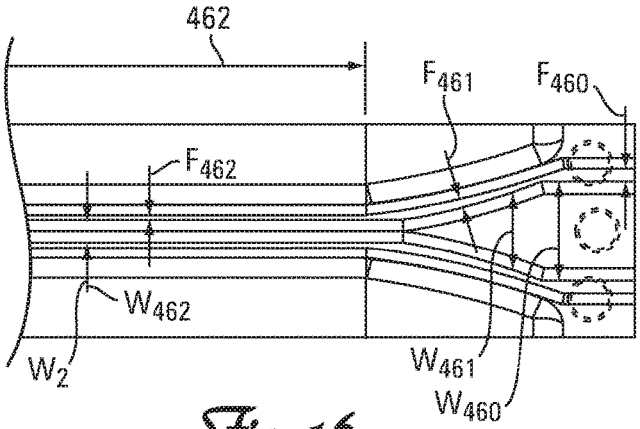
Fig. 16
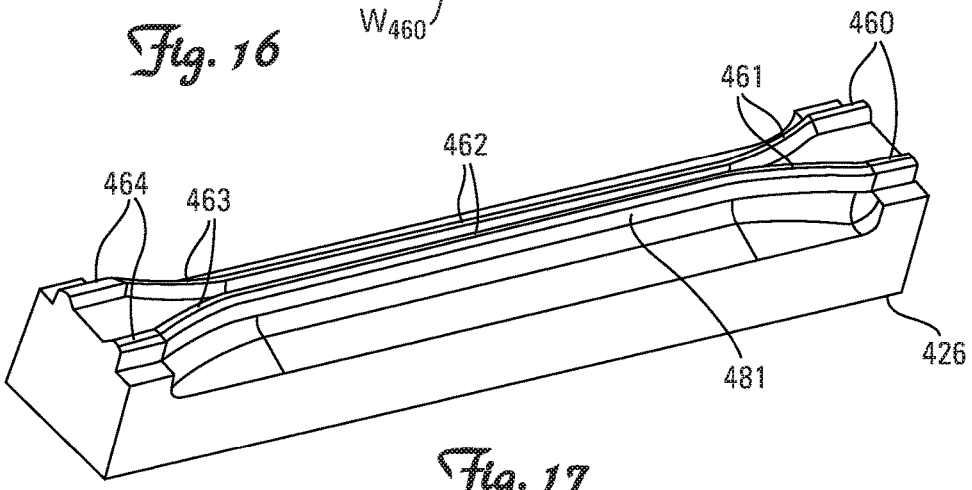
Fig. 17

BLOCK SPLITTER ASSEMBLY AND METHOD OF PRODUCING WALL BLOCKS

This application claims the benefit of U.S. Provisional Application No. 62/149,981, filed Apr. 20, 2015, entitled "Block Splitter Assembly and Method of Producing Wall Blocks", the contents of which are hereby incorporated by reference.

FIELD OF THE INVENTION

The invention relates generally to the manufacture of concrete wall blocks. More specifically, it relates to equipment and processes for the creation of faces on concrete wall blocks, especially a block splitter assembly.

BACKGROUND OF THE INVENTION

Retaining walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

A widely accepted method of construction of such walls is to dry stack concrete wall units, or blocks. These blocks are popular because they are mass produced and, consequently, relatively inexpensive. They are structurally sound and easy and relatively inexpensive to install. Because they are made of concrete, they are durable. They can be given a desired appearance such as, for example, natural stone.

Typically, retaining wall blocks are manufactured to have the desired appearance on the front face (i.e., the outer face of a wall) because the front is typically the visible side after the wall is constructed. In some applications, both the front and rear faces are visible due to changes in grade and other circumstances and therefore the rear face may be textured as well. It is highly desirable to have the front face of the wall system have a natural stone appearance, and many approaches are used in the art to treat or process concrete to evoke the appearance of natural stone, including splitting the block, tumbling the block to weather the face and edges of the face, and using processing or texturing equipment to impart a weathered look to the concrete. Typically, blocks are formed as mirror image pairs joined at a front face which are then subsequently split using a block splitter, as known in the art, to provide a rough appearing front surface on the split blocks.

Automated equipment to split block is well-known, and generally includes a splitting apparatus comprising a supporting table and opposed, hydraulically-actuated splitting blades. A splitting blade is typically a substantial steel plate that is tapered to a relatively narrow or sharp knife edge. The blades typically are arranged so that the knife edges will engage the top and bottom surfaces of the workpiece in a perpendicular relationship with those surfaces, and arranged in a coplanar relationship with each other. In operation, the workpiece is moved onto the supporting table and between the blades. The blades are brought into engagement with the top and bottom surfaces of the workpiece. An increasing force is exerted on each blade, urging the blades towards each other. As the forces on the blades are increased, the workpiece splits (cracks) generally along the plane of alignment of the blades. These machines are useful for the high-speed processing of blocks. They produce an irregular, rock-face finish on the blocks. Because no two faces resulting from this process are identical, the blocks are more natural in appearance than standard, nonsplit blocks.

There is a need for a block splitter assembly that provides a more complex form to the block than existing block splitter devices.

SUMMARY OF THE INVENTION

The invention provides a block splitter device comprising first lower and second upper opposed block splitter assemblies. The first block splitter assembly having a first end opposed from a second end, a first side surface opposed from a second side surface, a bottom surface, a center depression and exactly two first forming blades. The center depression extends the length of the first block splitter assembly as measured from the first end to the second end, one of the first forming blades being disposed to the right of and one of the first forming blades being disposed to the left of the center depression. The two first forming blades each have a single forming surface, each forming surface being horizontally planar and having first and second forming edges, each forming surface having a lateral width as measured from the first forming edge to the second forming edge, the lateral width of each forming surface having a larger dimension at the ends of the first block splitter assembly than towards the center of the first block splitter assembly. The second block splitter assembly having a first end opposed from a second end, a first side surface opposed from a second side surface, an upper surface, a center depression and exactly two second forming blades. The center depression extends the length of the second block splitter assembly as measured from the first end to the second end, one of the second forming blades being disposed to the right of and one of the second forming blades being disposed to the left of the center depression. The two second forming blades each have a single forming surface, each forming surface being horizontally planar and having first and second forming edges, each forming surface having a lateral width as measured from the first forming edge to the second forming edge, the lateral width of each forming surface having a larger dimension at the ends of the first block splitter assembly than towards the center of the first block splitter assembly. The forming surfaces of the forming blades of the first block splitter assembly are opposed to the forming surfaces of the forming blades of the second block splitter assembly.

In one embodiment, the block splitter device may include that one of the first forming blades is parallel to the other of the first forming blades for at least a portion of the length of the first block splitter assembly and one of the second forming blades is parallel to the other of the second forming blades for at least a portion of the length of the second block splitter assembly. In an embodiment, one of the first forming blades is parallel to the other of the first forming blades for the entire length of the first block splitter assembly and one of the second forming blades is parallel to the other of the second forming blades for the entire length of the second block splitter assembly.

In an embodiment, one of the first forming blades is parallel to the other of the first forming blades for at least one portion of the length of the first block splitter assembly and one of the first forming blades is non-parallel to the other of the first forming blades for at least one portion of the length of the first block splitter assembly, and one of the second forming blades is parallel to the other of the second forming blades for at least one portion of the length of the second block splitter assembly and one of the second forming blades is non-parallel to the other of the second forming blades for at least one portion of the length of the second block splitter assembly.

In an embodiment, one of the first forming blades is parallel to the other of the first forming blades for at least two non-consecutive portions of the lengths of each first forming blade and one of the second forming blades is parallel to the other of the second forming blades for at least two non-consecutive portions of the lengths of each second forming blade. In an embodiment, one of the first forming blades is non-parallel to the other of the first forming blades for at least two non-consecutive portions of the lengths of each first forming blade and one of the second forming blades is non-parallel to the other of the second forming blades for at least two non-consecutive portions of the lengths of each second forming blade.

In one embodiment, the lateral width of each of the forming surfaces have the same dimension for at least a portion of each of the lengths of the first forming blades and that the lateral width of each of the forming surfaces have the same dimension for at least a portion of each of the lengths of the second forming blades. In an embodiment, the lateral width of each of the forming surfaces has more than two different dimensions along each of the lengths of the first forming blades and that the lateral width of each of the forming surfaces has more than two different dimensions along each of the lengths of the second forming blades.

In one embodiment, the first and second opposed splitter blade assemblies are identical except for their opposed orientation. In an embodiment, the four first and second forming blades all have the same longitudinal length.

In one embodiment, each of the second forming edges of the first forming blades are adjacent the central depression of the first block splitter assembly and each of the second forming edges of the second forming blades are adjacent the central depression of the second block splitter assembly. The central depression of the first block splitter assembly has a lateral width as measured from the second forming edge of one of the first forming blades to the second forming edge of the other of the first forming blades and the central depression of the second block splitter assembly has a lateral width as measured from the second forming edge of one of the second forming blades to the second forming edge of the other of the second forming blades. In an embodiment, the lateral width of the central depression of the first block splitter assembly has the same dimension for at least a portion of the length of the first block splitter assembly and that the lateral width of the central depression of the second block splitter assembly has the same dimension for at least a portion of the length of the second block splitter assembly. In one embodiment, the lateral width of the central depression of the first block splitter assembly has at least two different dimensions along the length of the first block splitter assembly and that the lateral width of the central depression of the second block splitter assembly has at least two different dimensions along the length of the second block splitter assembly.

In an embodiment, the lateral width of the forming surface of the four first and second forming blades is from 1 mm to 5 mm. In one embodiment, the block splitter device may include first and second side knife assemblies.

The invention provides a block splitter device comprising first lower and second upper opposed block splitter assemblies. The first block splitter assembly has a first end opposed from a second end, a first side surface opposed from a second side surface, a bottom surface, a center depression and exactly two first forming blades. The center depression extends the length of the first block splitter assembly as measured from the first end to the second end, one of the first forming blades being disposed to the left of the center depression toward the first side surface and having a forming surface with first and second forming edges, the first forming edge being in closer proximity to the first side surface than the second forming edge. The other of the first forming blades is disposed to the right of the center depression toward the second side surface and has a forming surface with first and second forming edges, the first forming edge being in closer proximity to the second side surface than the second forming edge. The forming surfaces of the forming blades are substantially horizontally planar. The central depression has a lateral width as measured from the second forming edge of one of the first forming blades to the second forming edge of the other of the first forming blades, the lateral width of the central depression having a larger dimension at the ends of the first block splitter assembly than towards the center of the first block splitter assembly. The second block splitter assembly having a first end opposed from a second end, a first side surface opposed from a second side surface, an upper surface, a center depression and exactly two second forming blades. The center depression extends the length of the second block splitter assembly as measured from the first end to the second end, one of the second forming blades being disposed to the left of the center depression toward the first side surface and having a forming surface with first and second forming edges, the first forming edge being in closer proximity to the first side surface than the second forming edge. The other of the second forming blades is disposed to the right of the center depression toward the second side surface and has a forming surface with first and second forming edges, the first forming edge being in closer proximity to the second side surface than the second forming edge. The forming surfaces of the forming blades are substantially horizontally planar. The central depression has a lateral width as measured from the second forming edge of one of the second forming blades to the second forming edge of the other of the second forming blades, the lateral width of the central depression having a larger dimension at the ends of the second block splitter assembly than towards the center of the second block splitter assembly. The forming surfaces of the first forming blades of the first block splitter assembly being opposed to the forming surfaces of the second forming blades of the second block splitter assembly.

The invention provides a block splitter assembly comprising a first end opposed from a second end, a first side surface opposed from a second side surface, a planar surface, a center depression and exactly two forming blades. The center depression extends a length of the block splitter assembly as measured from the first end to the second end, one of the forming blades being disposed to the right of and one of the forming blades being disposed to the left of the center depression. The two forming blades each have a single forming surface, each forming surface being horizontally planar and having first and second forming edges. Each forming surface has a lateral width as measured from the first forming edge to the second forming edge, the lateral width of each forming surface having a larger dimension at the ends of the block splitter assembly than towards the center of the block splitter assembly.

The invention provides a block splitter assembly comprising a first end opposed from a second end, a first side surface opposed from a second side surface, a planar surface, a center depression and exactly two forming blades. The center depression extends a length of the block splitter assembly as measured from the first end to the second end, one of the forming blades being disposed to the left of the center depression toward the first side surface and having a forming surface with first and second forming edges, the first forming edge being in closer proximity to the first side surface than the second forming edge. The other of the forming blades is disposed to the right of the center depression toward the second side surface and has a forming surface with first and second forming edges, the first forming edge being in closer proximity to the second side surface than the second forming edge. The forming surfaces of the forming blades are substantially horizontally planar. The central depression has a lateral width as measured from the second forming edge of one of the first forming blades to the second forming edge of the other of the forming blades, the lateral width of the central depression having a larger dimension at the ends of the block splitter assembly than towards the center of the block splitter assembly.

The invention provides a method of producing a concrete block comprising providing a block splitter device having first lower and second upper opposed splitter blade assemblies. The first block splitter assembly having a first end opposed from a second end, a first side surface opposed from a second side surface, a bottom surface, a center depression and exactly two first forming blades. The center depression extends the length of the first block splitter assembly as measured from the first end to the second end, one of the first forming blades being disposed to the right of and one of the first forming blades being disposed to the left of the center depression. The two first forming blades each have a single forming surface, each forming surface being horizontally planar and having first and second forming edges. Each forming surface has a lateral width as measured from the first forming edge to the second forming edge, the lateral width of each forming surface having a larger dimension at the ends of the first block splitter assembly than towards the center of the first block splitter assembly. The second block splitter assembly has a first end opposed from a second end, a first side surface opposed from a second side surface, an upper surface, a center depression and exactly two second forming blades. The center depression extends the length of the second block splitter assembly as measured from the first end to the second end, one of the second forming blades being disposed to the right of and one of the second forming blades being disposed to the left of the center depression. The two second forming blades each having a single forming surface, each forming surface being horizontally planar and having first and second forming edges. Each forming surface having a lateral width as measured from the first forming edge to the second forming edge, the lateral width of each forming surface having a larger dimension at the ends of the second block splitter assembly than towards the center of the second block splitter assembly. The forming surface of the first block splitter assembly is opposed to the forming surface of the second block splitter assembly. The method further includes placing a concrete workpiece in the block splitter device at a splitting position to be engaged by the first and second block splitter assemblies; and with the workpiece at the splitting position, activating the first and second block splitter assemblies to engage the workpiece and thereby split and form the workpiece.

The invention provides a method of producing a concrete block comprising providing a block splitter device having first lower and second upper opposed block splitter assemblies. The first block splitter assembly has a first end opposed from a second end, a first side surface opposed from a second side surface, a bottom surface, a center depression and exactly two first forming blades. The center depression extends the length of the first block splitter assembly as measured from the first end to the second end, one of the first forming blades being disposed to the left of the center depression toward the first side surface and having a forming surface with first and second forming edges, the first forming edge being in closer proximity to the first side surface than the second forming edge, The other of the first forming blades is disposed to the right of the center depression toward the second side surface and has a forming surface with first and second forming edges, the first forming edge being in closer proximity to the second side surface than the second forming edge. The forming surfaces of the forming blades are substantially horizontally planar. The central depression has a lateral width as measured from the second forming edge of one of the first forming blades to the second forming edge of the other of the first forming blades, the lateral width of the central depression having a larger dimension at the ends of the first block splitter assembly than towards the center of the first block splitter assembly. The second block splitter assembly has a first end opposed from a second end, a first side surface opposed from a second side surface, an upper surface, a center depression and exactly two second forming blades. The center depression extends the length of the second block splitter assembly as measured from the first end to the second end, one of the second forming blades being disposed to the left of the center depression toward the first side surface and having a forming surface with first and second forming edges, the first forming edge being in closer proximity to the first side surface than the second forming edge. The other of the second forming blades is disposed to the right of the center depression toward the second side surface and has a forming surface with first and second forming edges, the first forming edge being in closer proximity to the second side surface than the second forming edge. The forming surfaces of the forming blades are substantially horizontally planar. The central depression has a lateral width as measured from the second forming edge of one of the second forming blades to the second forming edge of the other of the second forming blades, the lateral width of the central depression having a larger dimension at the ends of the second block splitter assembly than towards the center of the second block splitter assembly. The forming surface of the first block splitter assembly is opposed to the forming surface of the second block splitter assembly. The method further includes placing a concrete workpiece in the block splitter device at a splitting position to be engaged by the first and second block splitter assemblies; and with the workpiece at the splitting position, activating the first and second block splitter assemblies to engage the workpiece and thereby split and form the workpiece.

The invention provides a block splitter device including a block splitter assembly having a first section and a second section. The first and second sections each have a first end opposed from a second end, a first side surface opposed from a second side surface, and a forming blade. The second side surface of the first section of the block splitter assembly is configured to removably attach to the second side surface of the second section of the block splitter assembly. When the second side surface of the first section is attached to the second side surface of the second section, the block splitter assembly has exactly two forming blades, and a center depression extending a length of the block splitter assembly as measured from a first end to a second end of the block splitter assembly. The central depression has a lateral width as measured from the forming blade of the first section to the forming blade of the second section, the lateral width of the central depression having a larger dimension at the ends of the block splitter assembly than towards the center of the block splitter assembly.

The invention provides for a block splitter device including a block splitter assembly having a first section and a second section, the first and second sections each having a first end opposed from a second end, a first side surface opposed from a second side surface, and a forming blade. The second side surface of the first section of the block splitter assembly is configured to removably attach to the second side surface of the second section of the block splitter assembly. When the second side surface of the first section is attached to the second side surface of the second section, the block splitter assembly has two forming blades each having a single forming surface. Each forming surface is horizontally planar and has first and second forming edges, each forming surface having a lateral width as measured from the first forming edge to the second forming edge. The lateral width of each forming surface has a larger dimension at the ends of the block splitter assembly than towards the center of the block splitter assembly.

The invention provides for a block splitter device including a block splitter assembly having a first section and a second section, the first and second sections each having a first end opposed from a second end, a first side surface opposed from a second side surface, and a forming blade. The second side surface of the first section of the block splitter assembly is configured to removably attach to the second side surface of the second section of the block splitter assembly. When the second side surface of the first section is attached to the second side surface of the second section the block splitter assembly has exactly two forming blades, and a center depression extending a length of the block splitter assembly as measured from a first end to a second end of the block splitter assembly. The central depression has a depth as measured from an uppermost surface of the forming blades to a lowermost surface of the center depression, the depth of the central depression having a larger dimension at the ends of the block splitter assembly than towards the center of the block splitter assembly.

The invention provides a block splitter device including a block splitter assembly having a first section and a second section, the first and second sections each having a first end opposed from a second end, a first side surface opposed from a second side surface and a forming blade. The second side surface of the first section of the block splitter assembly is configured to removably attach to the second side surface of the second section of the block splitter assembly. When the second side surface of the first section is attached to the second side surface of the second section the block splitter assembly has two forming blades and a center depression extending a length of the block splitter assembly as measured from a first end to a second end of the block splitter assembly. The central depression has at least one opening extending from a lower surface of the center depression toward a lower surface of the block splitter assembly.

In one embodiment the at least one opening has side walls and the side walls taper outward from the lower surface of the center depression toward the lower surface of the block splitter assembly. In another embodiment the at least one opening is at least two openings. In another embodiment the at least one opening is round and in another embodiment the at least one opening is a slot.

In one embodiment the center depression has a depth as measured from the upper surface of the forming blade to the lower surface of the center depression and the depth of the center depression is greater towards the ends of the center depression than towards a mid-point of the center depression.

It is to be understood that both the foregoing general description and the following detailed description are exemplary and explanatory and are intended to provide further explanation of the invention as claimed.

BRIEF DESCRIPTION OF THE SEVERAL VIEWS OF THE DRAWING

FIG. 14 is an end view of the first block splitter assembly of FIG. 11.

FIG. 15 is an exploded view of a portion of FIG. 14.

FIG. 16 is a top view of a portion of the first block splitter assembly of FIG. 11.

FIG. 17 is a perspective view of the first block splitter assembly of FIG. 11.

DETAILED DESCRIPTION OF THE PREFERRED EMBODIMENTS

Figure 1:
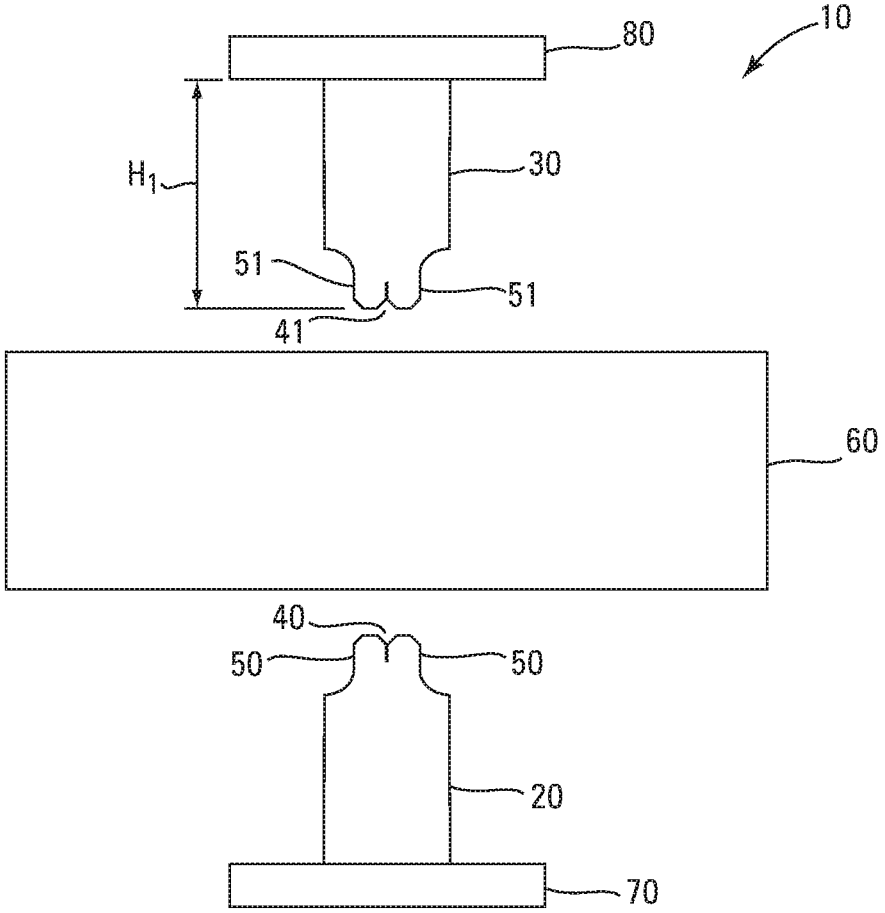
FIG. 1 is an end view of a block splitter device positioned to split a workpiece.

The invention relates to methods for the splitting of concrete wall block workpieces to create complex appearances in the faces of concrete retaining wall blocks that result from splitting the workpieces. The invention may be used with any variety of blocks molded or formed through any variety of processes.

The invention provides a block splitter device having a block splitter assembly. The block splitter assembly has opposed first and second end surfaces, opposed first and second side surfaces, and a compound forming surface. The forming surface of the block splitter assembly has a center depression or trough located along a center axis line that extends from the first end surface to the second end surface of the block splitter assembly. The center depression or trough may extend outward from the center axis line toward the first side surface of the block splitter assembly at a desired distance and may also extend outward from the center axis line toward the second side surface of the block splitter assembly at a desired distance. The block splitter assembly also has two forming blades. One forming blade is disposed to the left of the center axis line and center depression toward the first side surface of the block splitter assembly and one forming blade is disposed to the right of the center axis line and center depression toward the second side surface of the block splitter assembly. The two forming blades have a flat horizontal forming surface along the apex of each of the forming blades. Additionally, the forming surfaces of the first forming blades may have angled surfaces that angle outward from the horizontally planar forming surfaces along first and second forming edges of the forming surface of the block splitter assembly. The two forming blades have at least portions of the forming edges and forming surfaces that are straight and parallel to one another. The forming blades are separated from one another by a distance, the distance also being the width of the center depression. The width of the center depression may have the same dimension or may vary along the length of the block splitter assembly from one end to the other end of the block splitter assembly.

The invention provides a block splitter device comprising first lower and second upper opposed block splitter assemblies. The first block splitter assembly has opposed first and second end surfaces, opposed first and second side surfaces, a compound upper forming surface and a bottom surface. The upper forming surface of the first block splitter assembly has a center depression or trough located along a center axis line that extends from the first end surface to the second end surface of the first block splitter assembly. The center depression or trough may extend outward from the center axis line toward the first side surface of the first block splitter assembly at a desired distance and may also extend outward from the center axis line toward the second side surface of the first block splitter assembly at a desired distance. The first block splitter assembly also has two first forming blades. One first forming blade is disposed to the left of the center axis line and center depression toward the first side surface of the block splitter assembly and one first forming blade is disposed to the right of the center axis line and center depression toward the second side surface of the first block splitter assembly. The two first forming blades have a flat horizontal forming surface along the apex of each of the first forming blades. Additionally, the forming surfaces of the first forming blades may have angled surfaces that descend outward from the forming surfaces along first and second forming edges toward the bottom surface of the first block splitter assembly. The two first forming blades have at least portions of the forming edges and forming surfaces that are straight and parallel to one another other. The two first forming blades may each have the same maximum vertical dimension extending upward from the bottom surface of the first block splitter assembly along the length of the first block splitter assembly or may have differing maximum vertical dimensions along the length of the first splitter block assembly. The first forming blades are separated from one another by a distance, the distance also being the width of the center depression. The width of the center depression may have the same dimension or may vary along the length of the first block splitter assembly from one end to the other end of the first block splitter assembly.

The second block splitter assembly has opposed first and second end surfaces, opposed first and second side surfaces, a compound lower forming surface and an upper surface. The lower forming surface of the second block splitter assembly has a center depression or trough located along a center axis line that extends from the first end surface to the second end surface of the second block splitter assembly. The center depression or trough may extend outward from the center axis line toward the first side surface of the second block splitter assembly at a desired distance and may also extend outward from the center axis line toward the second side surface of the second block splitter assembly at a desired distance. The second block splitter assembly also has two second forming blades. One second forming blade is disposed to the left of the center axis line and center depression toward the first side surface of the second block splitter assembly and one second forming blade is disposed to the right of the center axis line and center depression toward the second side surface of the second block splitter assembly. The two second forming blades have a flat horizontal forming surface along the nadir or bottommost area of each of the second forming blades. Additionally, the forming surfaces of the second forming blades may have angled surfaces that ascend outward from the forming surfaces along first and second forming edges toward the upper surface of the second block splitter assembly. The two second forming blades have at least portions of the forming edges and forming surfaces that are straight and parallel to one another. The two second forming blades may each have the same maximum vertical dimension extending downward from the upper surface to the forming surface of the forming blades along the length of the second block splitter assembly, or may have differing maximum vertical dimensions along the length of the second block splitter assembly. The forming edges of the first forming blades may be opposed to the forming edges of the second forming blades. The first forming blades are separated from one another by a distance, the distance also being the width of the center depression. The width of the center depression may have the same dimension or may vary along the length of the second block splitter assembly from one end to the other end of the second block splitter assembly.

The invention provides a splitter blade assembly having a center depression and first, second, and third forming blades. The first forming blade is disposed to the right of and the second and third forming blades are disposed to the left of the center depression. The forming blades have forming surfaces and forming edges. The first, second, and third forming blades have longitudinal lengths, and the longitudinal length of the first forming blade are equal to or greater than the sum of the longitudinal lengths of the second and third forming blades. The first forming blade is separated from the second and third forming blades by a distance, the distance also being the width of the center depression. The width of the center depression may have the same dimension or may vary along the length of the block splitter assembly from one end to the other end of the block splitter assembly.

The invention provides a method of producing a concrete block comprising: (i) providing a block splitter device comprising first lower and second upper opposed block splitter assemblies, (ii) placing a concrete workpiece in the block splitter device at a splitting position to be engaged by the first and second block splitter assemblies; and (iii) with the workpiece at the splitting position, activating the first and second block splitter assemblies to engage the workpiece and thereby split and form the workpiece. The block splitter device and assembly can be any block splitter device and assembly described herein.

Turning now to the Figures, the block splitter assemblies and other aspects of this invention are shown and described.

In FIG. 1, a block splitter device in accordance with invention is depicted, in part, showing in particular an end view of block splitter device 10. Block splitter device 10 may have opposed first 20 and second 30 block splitter assemblies. The first or lower block splitter assembly 20 is positioned at the bottom of the block splitter machine 10 and, as depicted, includes first center depression or trough 40 and two forming blades 50 positioned on each side of the first center depression or trough 40. The first block splitter assembly 20 is attached to the bottom mounting plate 70 of the block splitter device 10.

An upper or second splitter blade assembly 30 may also be seen in FIG. 1. The second block splitter assembly 30 also includes a second center depression or trough 41 and two forming blades 51 positioned on each side of the second center depression or tough 41. The second block splitter assembly 30 is attached to the top mounting plate 80 of the block splitter device 10. A workpiece 60 is shown in FIG. 1. The position of the workpiece 60 within the block splitter device 10 is shown in FIG. 1 in the ready-to-split position.

Figure 2:
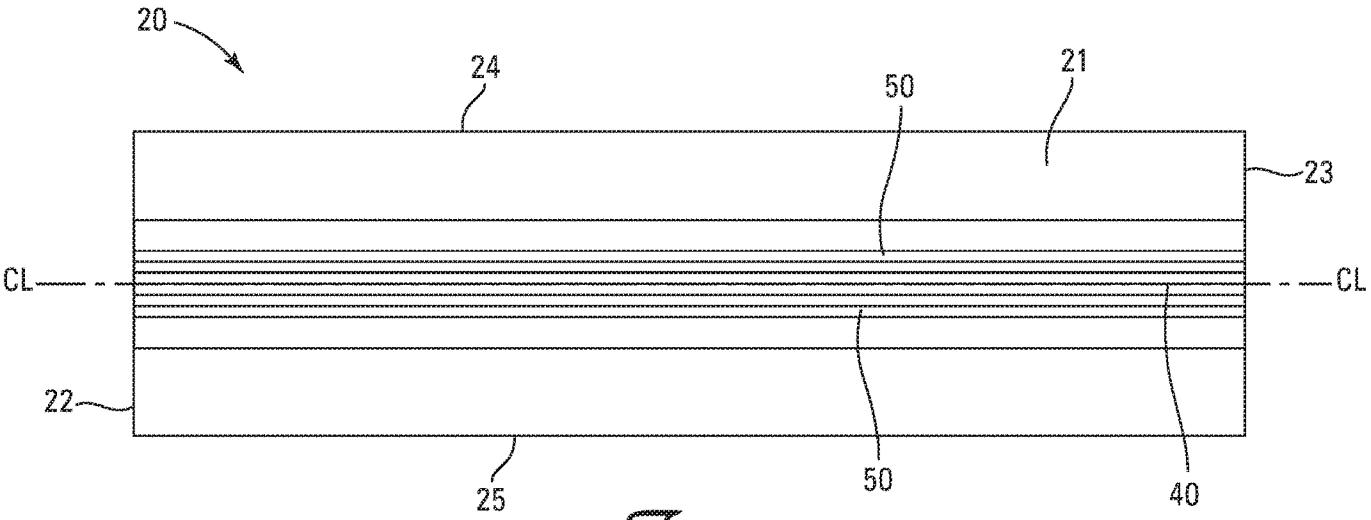
FIG. 2 is a top view of a first block splitter assembly of FIG. 1.
Figure 4:
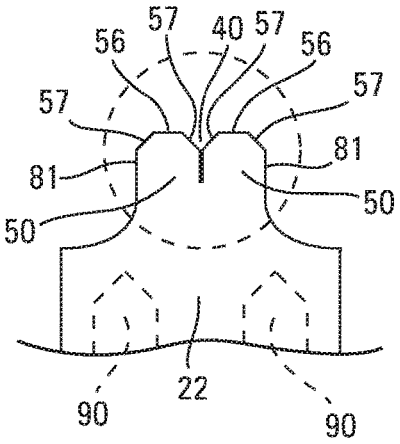
FIG. 4 is an end view of the first block splitter assembly of FIG. 1.
Figure 6:
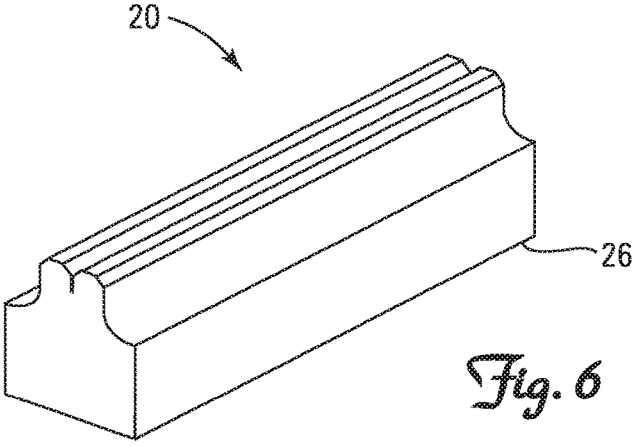
FIG. 6 is a perspective view of the first block splitter assembly of FIG. 1.

FIG. 2 is a top view of the first block splitter assembly 20. As seen in FIGS. 2, 4 and 6, the first block splitter assembly has an upper forming surface 21, bottom surface 26, opposed end surfaces 22 and 23, respectively, and opposed first and second side surfaces 24 and 25, respectively. First block splitter assembly 20 has first center depression or trough 40 located along a center axis line CL that extends from one end of the first block splitter assembly to the opposed end of the first block splitter assembly. Center axis line CL may also be the line of symmetry for the first block splitter 20 and may also be the bisecting line of first center depression or trough 40. First block splitter assembly 20 has two first forming blades 50, one first forming blade is located to the left of the center axis line CL when viewed from one of the ends of the first block splitter assembly and the other first forming blade is located to the right of the center axis line CL.

Figure 3:
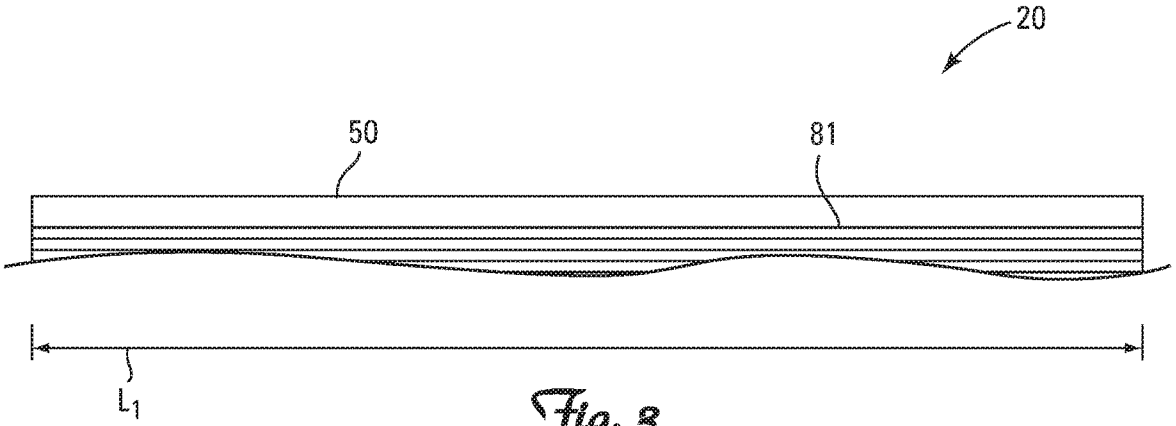
FIG. 3 is a side view of the first block splitter assembly of FIG. 1.

FIG. 3 is a partial side view of the first block splitter assembly 20 showing length $L_1$ (which may, for example, be 469.9 mm) of the first block splitter blade. Height $H_1$ (which may, for example, be 38.1 mm) of the block splitter assemblies 20 and 30 can be seen in FIG. 1. It should be understood that the height and length are not limiting and the block splitter assemblies could have any desired dimensions. At least a portion of one of the first forming blades 50 of the first block splitter assembly may be parallel to at least a portion of the other first forming blade 50 of the first block splitter assembly for a distance along the length $L_1$ of the first block splitter assembly. It should be understood that the forming blades 50 of the first block splitter assembly 20 may also be parallel to each other along the entire length $L_1$ of the first block splitter assembly. The height of forming blades 50 may be the same as the height $H_1$ of the first block splitter assembly and the length of forming blades 50 may be the same as the length $L_1$ of the first block splitter assembly. Each forming blade 50 has a vertically extending outer wall 81, at least a portion of outer wall 81 is perpendicular to bottom surface 26.

Figure 5:
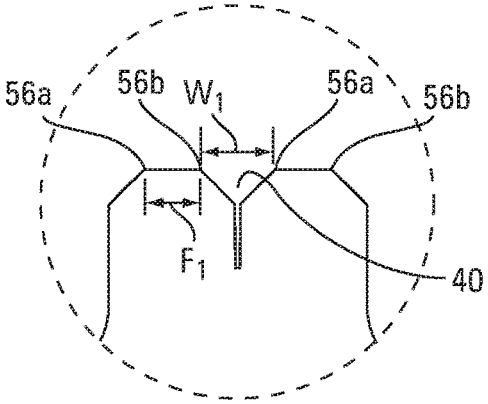
FIG. 5 is an exploded view of a portion of FIG. 4.

FIG. 4 is a partial end view of the first block splitter assembly and shows mounting holes 90 in phantom. Mounting holes 90 are used to mount the first block splitter assembly 20 to the bottom mounting plate 70 (not shown). FIG. 5 is an exploded view of a portion of FIG. 4 showing the details of the first center depression or trough 40 and forming blades 50. Forming blades 50 have an apical or uppermost planar forming surface 56 that may be substantially flat or horizontally planar and may be the uppermost surface of the first block splitter assembly. Angular forming surfaces 57 of forming blades 50 angularly descend a distance from first and second forming edges 56*a* and 56*b*, respectively, of each planar forming surface 56 toward bottom surface 26 of the first block splitter assembly. Angular surfaces 57 may have any desired degree of downward slope and could, for example, descend at a 45° relative to a horizontal plane of forming surface 56. Forming surfaces 56 of forming blades 50 each have a lateral width $F_1$ as measured from forming edge 56*a* to forming edge 56*b* (which may, for example be in the range from 1 mm to 5 mm). Lateral width $F_1$ may be the same dimension along the entire length of each forming blade 50 or may have varying dimensions along the length of each forming blade 50 as desired.

As shown in FIG. 5, the apical forming surfaces 56 of forming blades 50 are spaced a distance $W_1$ from each other as measured from forming edge 56*b* of the first forming blade located to the left of the first center depression 40 to edge 56*a* of the first forming blade 50 located to the right of the first center depression 40 of the first splitter block assembly (which may be in a range of 3 mm to 10 mm and could, for example, be 6.35 mm). Distance $W_1$ is also the lateral width of first center depression or trough 40. Center depression or trough 40 may include angular surface 57 extending from edge 56*b* of the first forming blade 50 located toward the first side surface (and to the left of center depression 40) of the first block splitter assembly and may also include angular surface 57 extending from edge 56*a* of the first forming blade 50 located toward the second side surface (and to the right of center depression 40) of the first splitter block assembly. Distance $W_1$ may have the same dimension extending the length $L_1$ of the first block splitter assembly, or may have varying dimensions along the length $L_1$ of the first block splitter assembly as desired. FIG. 6 shows a perspective view of the first block splitter assembly 20.

The second block splitter assembly 30 is identical to the first block splitter assembly 20 except for its orientation relative to the workpiece 60. For example, the bottom surface of the first block splitter assembly is the upper surface of the second block splitter assembly; the upper forming surface of the first block splitter assembly is the lower forming surface of the second block splitter assembly; planar forming surface 56 being the most apical surface of forming blade 50 of the first block splitter assembly is planar forming surface 56 located at the nadir or bottommost surface of forming blade 51 of the second block splitter assembly; and angular surfaces 57 extending from forming edges 56*a* and 56*b* of the second block splitter assembly ascend toward the upper surface of the second block splitter assembly at an upward slope from the horizontal plane of planar forming surface 56.

Figure 7:
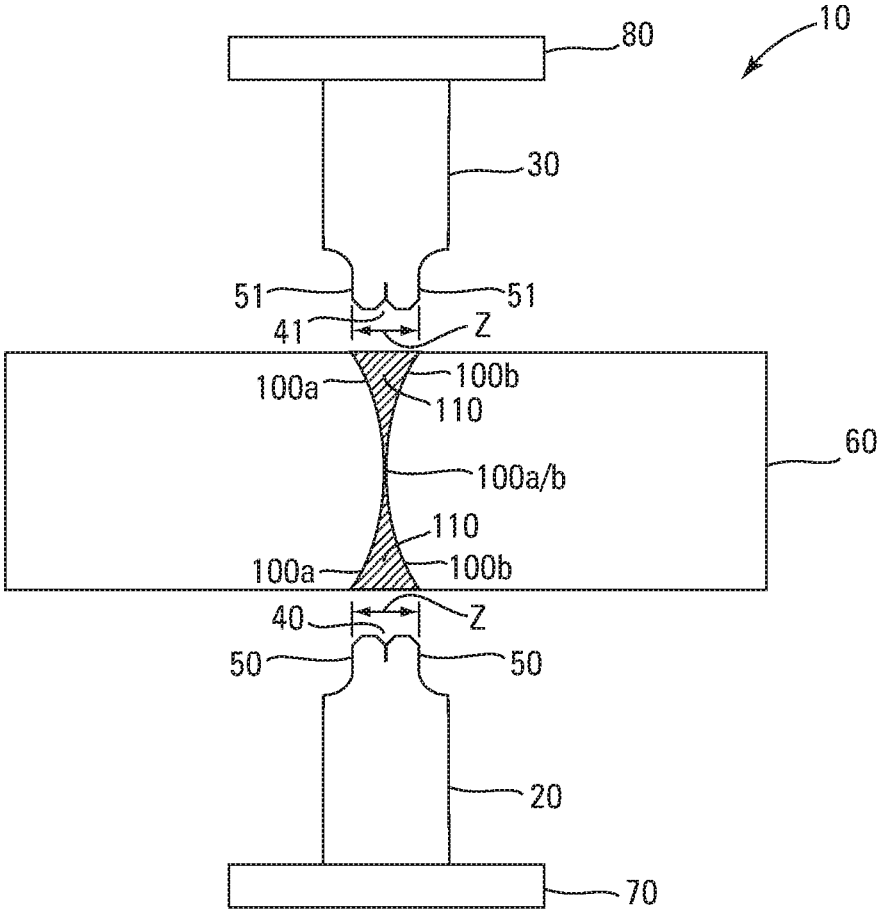
FIG. 7 is an end view of the block splitter device of FIG. 1 with the workpiece in the ready-to-split position.
Figure 8:
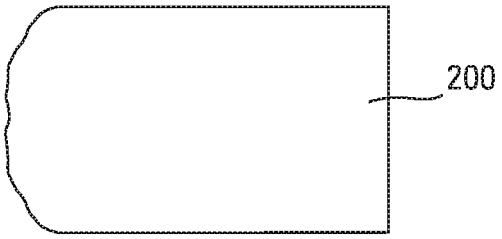
FIG. 8 is a side view of a block produced from the workpiece 60 by the block splitter device of FIG. 1.

FIG. 7 is an end view of the block splitter device 10 with the workpiece 60 in the ready-to-split position. The workpiece 60 is shown with split lines 100*a* and 100*b* and removed portions 110 (shaded). When the workpiece 60 is split using the block splitter assembly 10, the workpiece breaks along the split lines 100*a* and 100*b*, which are produced by the first and second forming blades 50 and 51. The removed portions 110 are also produced by the forming blades 50 and 51. The location of the forming blades 50 and 51 on the left and right sides of center depressions 40 and 41 of block splitter assemblies 20 and 30 result in irregularly contoured split lines 100*a* and 100*b* that converge towards one another from the top surface to the center of the workpiece 60 and that converge toward one another from the bottom surface toward the center of the workpiece 60. As can be seen in FIG. 7, as split lines 100*a* and 100*b* converge from the top surface to the center of the workpiece or from the bottom surface to the center of the workpiece, split lines 100*a* and 100*b* may converge into a singular joined splitting line 100*a/b* and is the location where the workpiece 60 is split directly into two pieces with no removed portions. Singular split line 100*a/b* may be located in an area vertically adjacent and within the lateral width of the center depressions or troughs 40 and 41 of blocks splitter assemblies 20 and 30. Removed portions 110 generally are more pronounced or wider toward the top and bottom of the workpiece narrowing toward the center of the block and along with split lines 100*a* and 100*b* may be located in an area vertically adjacent and within the lateral width Z of the two forming blades and center depression of block splitter assemblies 20 and 30. FIG. 8 shows a side view of a block 200 produced from the workpiece 60 by the block splitter device 10.

In operation, the workpiece 60 is generally centered in the block splitter according to known practices as seen in FIGS. 1 and 7. The block splitter device 10 is then activated resulting in the first and second opposing block splitter assemblies 20, 30 converging on, and striking, the workpiece 60. The first and second block splitter assemblies may travel anywhere from about ⅝ to one inch (1.59 to 2.54 cm) into the top and bottom surfaces of the workpiece 60. The workpiece 60 is then split as shown in FIG. 7. However, it is possible and within the scope of the invention to split the workpiece into more than two pieces. Generally, the splitter assemblies act on the block with a pressure ranging from about 600 to 1000 psi (42.2 to 70.3 kg/cm$^2$), and preferably about 750 to 800 psi (52.7 to 56.2 kg/cm$^2$).

Figure 9:
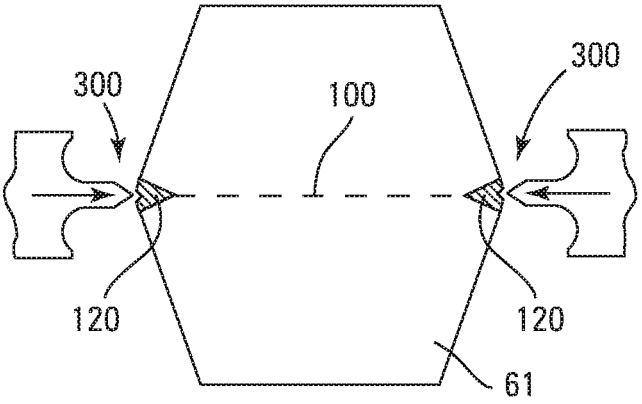
FIG. 9 is a top view of side knife assemblies and a workpiece.
Figure 10:
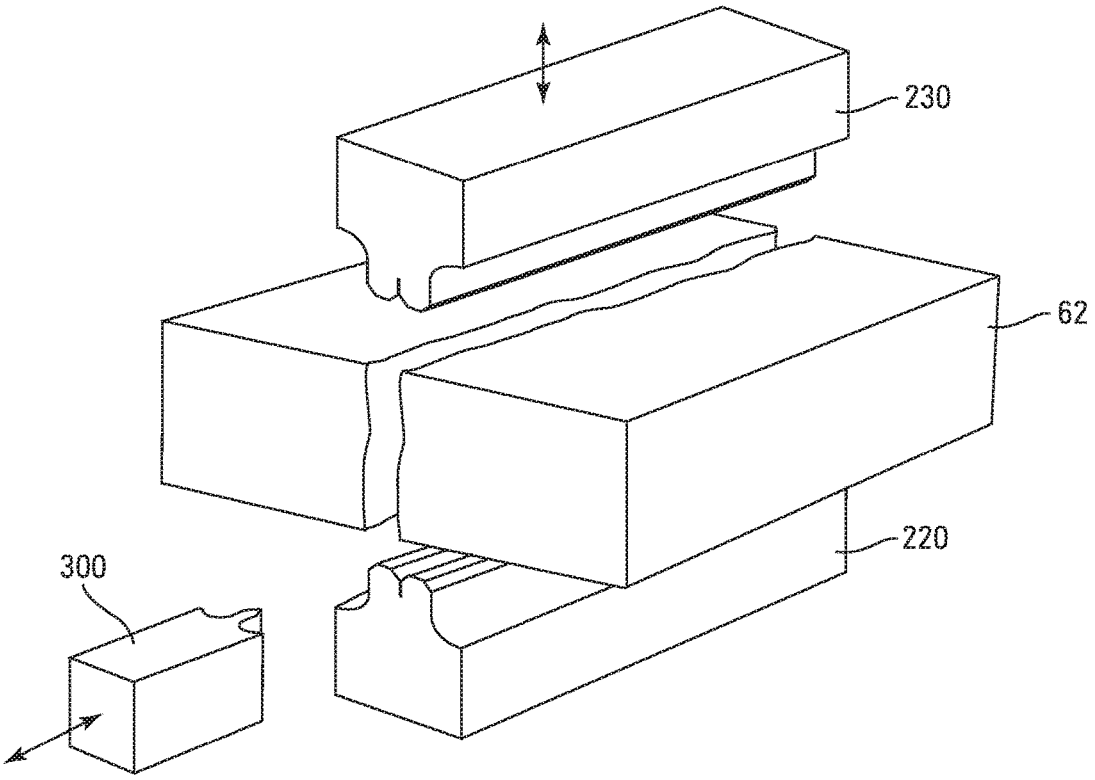
FIG. 10 is a perspective view of a side knife assembly, opposed first lower and second upper block splitter assemblies, and a workpiece.

As will be well understood by one of skill in the art, the splitter device may include opposed hydraulically activated side knife assemblies which preferably impinge upon the block with the same timing and in the same manner as the opposed first and second block splitter assemblies 20, 30. The side knife assemblies could be formed similarly to the first and second block splitter assemblies 20, 30 to produce similar removed portions. In addition, variations in the block splitter assemblies could be used to produce blocks having removed portions on just the top and bottom of the face of a block, the top and bottom and sides, the top and sides, or the sides only. FIG. 9 shows a top view of side knife assemblies 300, removed portions 120, and split line 100 on a workpiece 61. FIG. 10 shows a perspective view of a side knife assembly 300, side knife assembly 301 (not shown, opposite side knife assembly 300), opposed first lower and second upper block splitter assemblies 220, 230, and workpiece 62.

Figure 11:
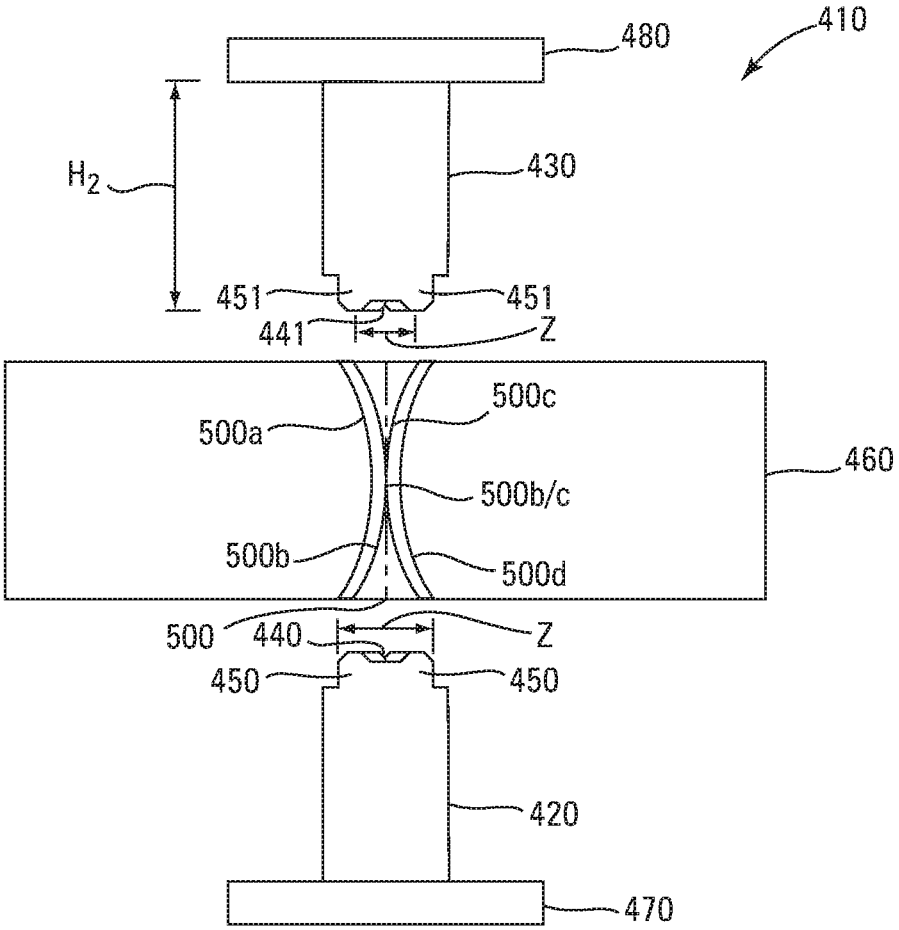
FIG. 11 is an end view of an alternative block splitter device positioned to split a workpiece.

FIG. 11 is an end view of the block splitter device 410 showing an alternative block splitter device of the present invention. Block splitter device 410 has generally opposed first 420 and second 430 block splitter assemblies. The first or lower block splitter assembly 420 is positioned at the bottom of the block splitter device 410 and, as depicted, includes first center depression or trough 440 and two forming blades 450 positioned on each side of the first center depression or trough 440. The first block splitter assembly 420 is attached to the bottom mounting plate 470 of the block splitter assembly 410.

An upper or second block splitter assembly 430 may also be seen in FIG. 11. The second block splitter assembly 430 also includes a second center depression or trough 441 and two forming blades 451 positioned on each side of the second center depression or trough 441. The second block splitter assembly 430 is attached to the top mounting plate 480 of the block splitter assembly 410. A workpiece 460 is shown in FIG. 11. The position of the workpiece 460 within the block splitter device 410 is shown in FIG. 11 in the ready-to-split position.

Figure 12:
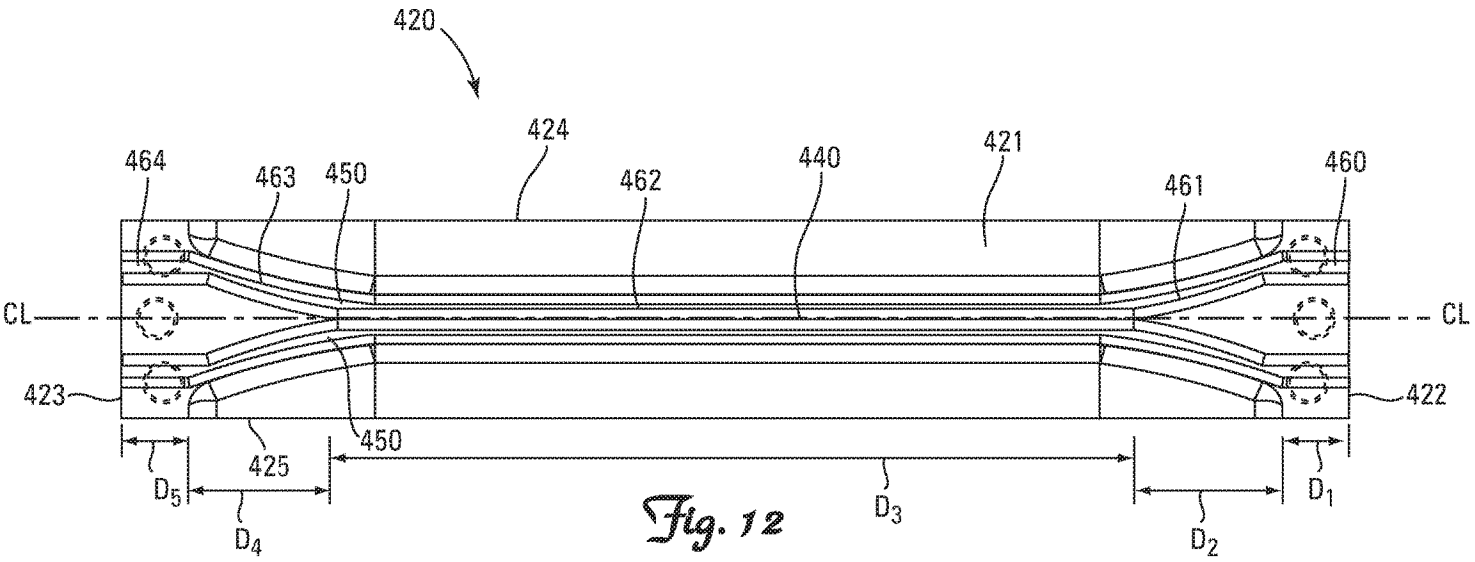
FIG. 12 is a top view of a first block splitter assembly of FIG. 11.

FIG. 12 is a top view of the first block splitter assembly 420. As seen in FIGS. 12 and 14, first block splitter assembly has an upper forming surface 421, bottom surface 426, opposed first and second end surfaces 422 and 423, respectively, and opposed first and second side surfaces 424 and 425, respectively. First block splitter assembly 420 has first center depression or trough 440 located along a center axis line CL that extends from one end of the first block splitter assembly to the opposed end of the first block splitter assembly. Center axis line CL may also be the line of symmetry for the first block splitter 420 and may also be the bisecting line of first center depression or trough 440. First block splitter assembly 420 has two first forming blades 450, one of the first forming blades 450 located toward the left of center axis line CL and the other of the first forming blades 450 located to the right of the center axis line CL when viewed from an end of the first block splitter assembly.

Figure 13:
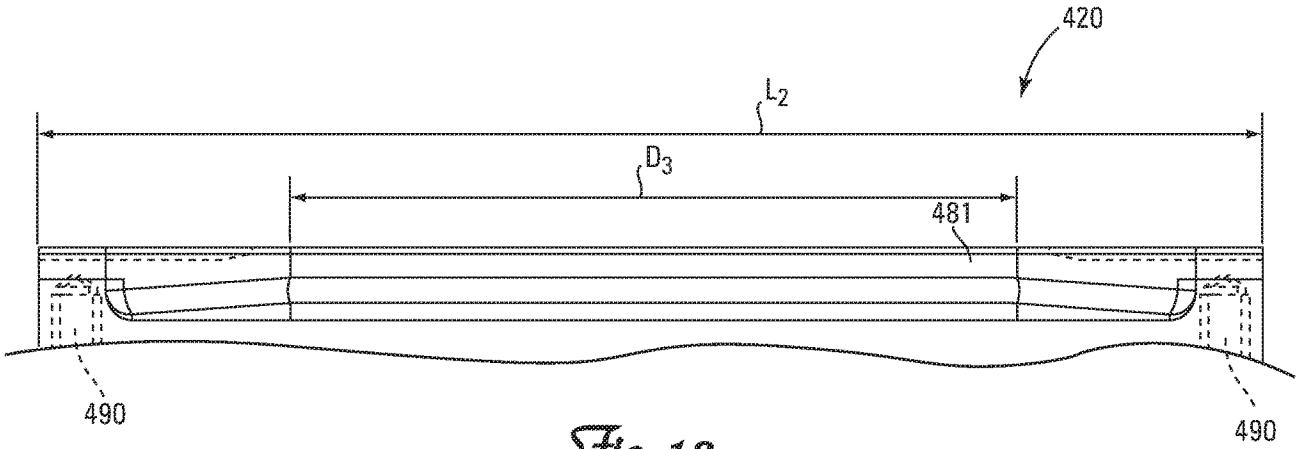
FIG. 13 is a side view of the first block splitter assembly of FIG. 11.

FIG. 13 is a partial side view of the first block splitter assembly 420 and shows mounting holes 490 in phantom. Mounting holes 490 are used to mount the first block splitter assembly 420 to the bottom mounting plate 470 (not shown). First block splitter assembly 420 has length $L_2$ (which may, for example, be 469.9 mm) and height $H_2$ (as seen in FIG. 11, which may, for example, be 38.1 mm). It should be understood that the height and length are not limiting and the block splitter assemblies could have any desired dimensions. The height of forming blades 450 may be the same as the height $H_2$ of the first block splitter assembly. Each forming blade 450 has a vertically extending outer wall 481, at least a portion of outer wall 481 is perpendicular to bottom surface 426.

FIG. 14 is an end view showing forming blades 450 having an apical or uppermost planar forming surface 456 that may be substantially flat or horizontally planar and may be the uppermost surface of the first block splitter assembly. Angular forming surfaces 457 of forming blades 450 angularly descend a distance from first and second forming edges 456*a* and 456*b*, respectively, of each planar forming surface 456 toward bottom surface 426 of the first block splitter assembly. FIG. 15 is an exploded view of a portion of FIG. 14 showing the details of the first center depression or trough 440 and forming blades 450. Angular surfaces 457 may have any desired degree of downward slope S and could, for example, descend at a 45° slope relative to a horizontal plane of forming surface 456. Planar forming surfaces 456 of forming blades 450 each have a lateral width $F_2$ as measured from forming edge 456*a* to forming edge 456*b* of each forming blade (which may, for example be in the range from 1 mm to 5 mm). Width $F_2$ may be the same dimension along the entire length of each forming blade 450 or may have varying dimensions along the length of each forming blade 450 as can be seen in FIG. 16 discussed further below. As shown in FIG. 15, the apical planar forming surfaces 456 of forming blades 450 are spaced a distance $W_2$ from each other as measured from forming edge 456*b* of the first forming blade located to the left of the first center depression 440 to edge 456*a* of the first forming blade 450 located to the right of the first center depression 440 of the first splitter block assembly. Distance $W_2$ is also the lateral width of first center depression or trough 440. Center depression or trough 440 may include angular surface 457 extending from edge 456*b* of the first forming blade 450 located toward the first side surface (and to the left of center depression 440) of the first block splitter assembly and angular surface 457 extending from edge 456*a* of the first forming blade 450 located toward the second side surface (and to the right of center depression 440) of the first splitter block assembly. Distance $W_2$ has varying dimensions extending along the length $L_2$ of the first block splitter assembly which could range from 3 mm to 55 mm. As can be seen in FIG. 16, distance $W_2$ has a smaller dimension toward the center of the first block splitter assembly (for example, 6.35 mm) than at the end of the first block splitter assembly (for example, 34.64 mm).

As can be seen in FIGS. 12 and 17, each first forming blade 450 has portions 460, 461, 462, 463 and 464 located along the length of the forming blade. Portions 460 of forming blades 450 extend a distance D1 from the first end 422 along the length $L_2$ of the first block splitter assembly. Distance D1 could, for example, be 25 mm. Portions 460 may also be parallel to each other. Portions 461 of each forming blade 450 converge from portions 460 toward center portions 462 and may have any desired length. Portions 461 extend from portions 460 a distance D2 along the length $L_2$ of the first block splitter assembly, and D2 could, for example be 70 mm. Center portions 462 of forming blades 450 extend a distance D3 from portions 461 toward portions 463 along the length $L_2$ of the first block splitter assembly. Distance D3 may be, for example, 280 mm. Center portions 462 may be parallel to each other. Portions 463 of each forming blade 450 converge from portions 464 toward center portions 462 and may have any desired length. Portions 463 extend from portions 464 a distance D4 toward portions 462 along the length $L_2$ of the first block splitter assembly. Distance D4 could, for example, be 70 mm. Distance D4 and distance D2 may have the same measurement. Portions 464 of forming blades 450 extend a distance D5 from the second end 423 along the length $L_2$ of the first block splitter assembly. Distance D5 could, for example, be 25 mm. Additionally, Distance D5 and Distance D1 may have the same measurement. Portions 464 may also be parallel to each other.

At least one portion of one of the first forming blades 450 of the first block splitter assembly may be parallel to at least one portion of the other first forming blade 450 of the first block splitter assembly for a distance along the length $L_2$ of the first block splitter assembly. For example, center portion 462 of one of the first forming blades 450 may be parallel to center portion 462 of the other first forming blade 450. Additionally, three portions 460, 462 and 464, respectively, of one of the first forming blades 450 may be parallel to three portions 460, 462 and 464, respectively, of the other of the first forming blades 450.

As shown in FIG. 16, forming edge 456*b* of the first forming blade located to the left of the first center depression 440 to edge 456*a* of the first forming blade 450 located to the right of the first center depression 440 of the first splitter block assembly are closer to each other in the center portion 462 of the first forming blades 450 than at the end portions 460 and 464 of the first forming blades. For example, center depression adjacent forming edge 456*b* of one of the first forming blades 450 may be up to 35 mm or more apart from center depression adjacent forming edge 456*a* of the other of the first forming blades 450 ($W_{460}$ and $W_{464}$ (not shown)) at forming blade portions 460 and 464 of the first splitter assembly 420. Moving along the length $L_2$ of the first block splitter assembly, from portions 460 and 464 of forming blades 450 toward portions 462, the distance between the forming edges 456*b* and 456*a* of portions 461 and 463 of the forming blades may decrease or narrow from 35 mm down to 6.35 mm ($W_{461}$ and $W_{463}$ (not shown)). The center section of the first block splitter assembly may have center depression adjacent forming edge 456*b* of one of the first forming blades 450 that may be 6.35 mm ($W_{462}$) apart from center depression adjacent edge 456*a* of the other of the first forming blades 450 at center portions 462. Center portion 462 of first block splitter assembly 420 may be identical to first block splitter assembly 20 shown in FIGS. 2 to 7. It should be understood that these dimensions are not limiting and that $W_{460}$, $W_{461}$, $W_{462}$, $W_{463}$, and $W_{464}$, could all have larger or smaller measured dimensions as desired. As shown in FIG. 16, the dimensions of the lateral width $F_2$ of forming surface 456 of each forming blade 450 as measured from forming edge 456*a* to 456*b* may vary along the length of the block splitter assembly such that the forming surface 456 at center portion 462 of the first forming blades 450 may have a narrower lateral width than the forming surface 456 at end portions 460 and 464 of the forming blades. For example, the lateral width of forming surface 456 may be 5.0 mm ($F_{460}$ and $F_{464}$ (not shown)) at forming blade portions 460 and 464 of the first splitter assembly 420. Moving along the length L2, the lateral width of forming surface 456 of portions 461 and 463 of the forming blades may decrease or narrow from 5.0 mm to 2.0 mm ($F_{461}$ and $F_{463}$ (not shown)). The lateral width of forming surface 456 of center section 462 may be 2.0 mm ($F_{462}$). It should be understood that these dimensions are not limiting and $F_{460}$, $F_{461}$, $F_{462}$, $F_{463}$, and $F_{464}$ could all have larger or smaller measured dimensions as desired.

As shown in FIG. 15, the center depression or trough 440 has a depth T as measured from lower depression surface 442 to planar forming surfaces 456 of the forming blades 450. Depth T may vary along the length of the length $L_2$ of the first splitter blade such that the depth T at center portion 462 of the first forming blades 450 may be smaller or more shallow than the depth T at end portions 460 and 464 of the forming blades. Depth T may also be constant along the length of L2.

The second block splitter assembly 430 is identical to the first block splitter assembly 420 except for its orientation relative to the workpiece 460. For example, the bottom surface of the first block splitter assembly is the upper surface of the second block splitter assembly; the upper forming surface of the first block splitter assembly is the lower forming surface of the second block splitter assembly; planar forming surface 456 being the most apical surface of forming blade 450 of the first block splitter assembly is planar forming surface 456 located at the nadir or bottom-most surface of forming blade 451 of the second block splitter assembly; and angular surfaces 457 extending from forming edges 456*a* and 456*b* of the second block splitter assembly ascend toward the upper surface of the second block splitter assembly at an upward slope from the horizontal plane of planar forming surface 456.

In alternative embodiments, various dimensions and angles could be changed. Additionally, the contour of forming blades 450 could be changed. For example, portions 460 and 461 could angle or curve away from center portion 462 and portions 463 and 464 could also angle or curve away from center portion 462.

FIG. 11 is an end view of the block splitter assembly 410 with the workpiece 460 in the ready-to-split position. The workpiece 460 is shown with primary split line 500. When the workpiece 460 is split using the block splitter assembly 410, the workpiece may break along secondary split lines 500*a*, 500*b*, 500*c* and 500*d*, produced by the forming blades 450 and 451. Removed portions 510 (not shown) are also produce by the forming blades 450 and 451. The location of the forming blades 450 and 451 on the left and right sides of center depressions 440 and 441 and the contour and positioning of portions 460, 462, and 464 of forming blades 450 and 451 of block splitter assemblies 420 and 430 result in irregularly contoured and variably located split lines 500*a*, 500*b*, 500*c* and 500*d*. Additionally, the contour and positioning of portions 461 and 463 of forming blades 450 and 451 result in further irregularly contoured and variably located split lines (not shown). Portions 460 and 464 (and center depression 440) produce split lines 500*a* and 500*d* that converge towards one another from the top surface to the center of the workpiece 460 and that converge toward one another from the bottom surface toward the center of the workpiece 460. Portions 462 (and center depression 440) produce split lines 500*b* and 500*c* that converge towards one another from the top surface to the center of the workpiece 460 and that converge toward one another from the bottom surface toward the center of the workpiece 460. As can be seen in FIG. 11, as split lines 500*b* and 500*c* converge from the top surface to the center of the workpiece or from the bottom surface to the center of the workpiece, split lines 500*b* and 500*c* may converge into a singular joined splitting line 500*a/b* that is the location where the workpiece 460 is split directly into 2 pieces with no removed portions. Singular split line 500*a/b* may be located in an area vertically adjacent and within the lateral width of the center depressions or troughs 440 and 441 of blocks splitter assemblies 420 and 430.

Figure 18:
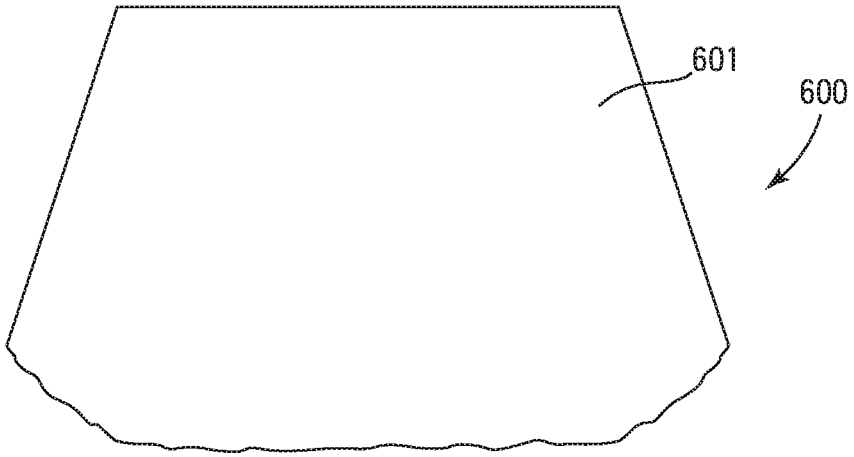
FIG. 18 is a top view of a block produced from workpiece 460 by the block splitter device of FIG. 11.
Figure 19:
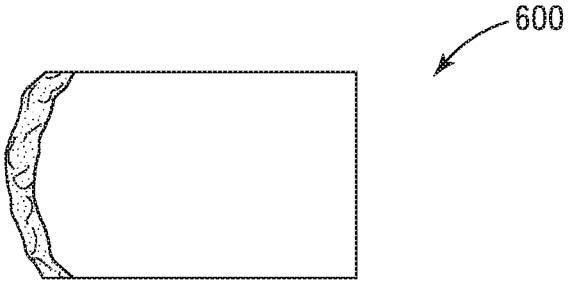
FIG. 19 is a side view of a block produced from the workpiece 460 by the block splitter device of FIG. 11.

Removed portions generally are more pronounced or wider toward the top and bottom of the workpiece narrowing toward the center of the block and along with split lines 500*a*, 500*b*, 500*c* and 500*d* and may be located in an area vertically adjacent and within the lateral width Z of the two forming blades and center depression of block splitter assemblies 420 and 430. FIGS. 18 and 19 show top and side views, respectively of block 600 produced by the block splitter device 410.

In operation, the workpiece 460 is generally centered in the block splitter device according to known practices as seen in FIG. 11. The block splitter device 410 is then activated resulting in the first and second opposing block splitter assemblies 420, 430 converging on, and striking, the workpiece 460, traveling anywhere from about ⅝ to one inch (1.59 to 2.54 cm) into the top and bottom surfaces of the workpiece. The block splitter assembly 410 operates similarly to the block splitter assembly 10. FIG. 18 shows the top surface 601 of a block 600 produced by the block splitter assembly 410. As shown in FIGS. 18 and 19, the removal of the removed portions 510 (not shown) produces a block having a substantially convex shape. Because of the shape of the forming blades 450, the face is convex along both the x and y axes of the face.

As will be well understood by one of skill in the art, the splitter machine may include opposed mechanically activated side knife assemblies which impinge upon the block with the same timing and in the same manner as the opposed first and second block splitter assemblies 420, 430. The side knife assemblies could be formed similarly to the first and second block splitter assemblies 420, 430 to produce similar removed portions. In addition, variations in the block splitter assemblies could be used to produce blocks having removed portions on just the top and bottom of the face of a block, the top and bottom and sides, the top and sides, or the sides only. In addition, the heights of and distances between the forming blades and the shapes of the forming blades can be varied to produce different blocks.

Figure 20:
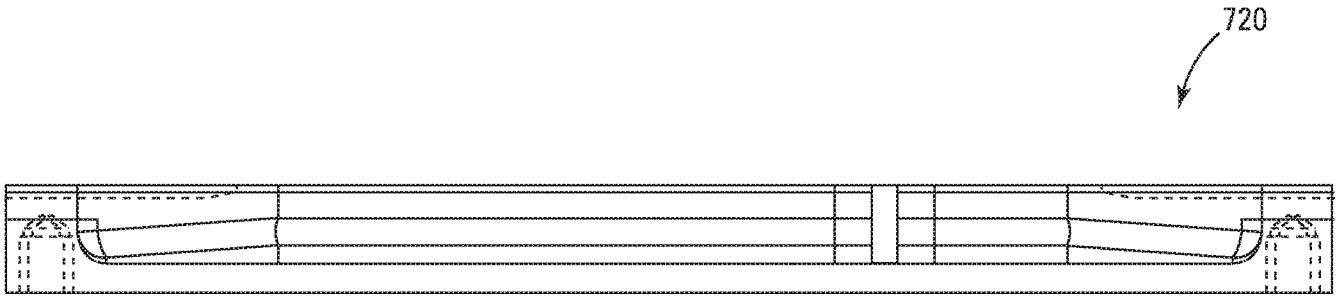
FIG. 20 is a side view of an alternative block splitter assembly.
Figure 21:
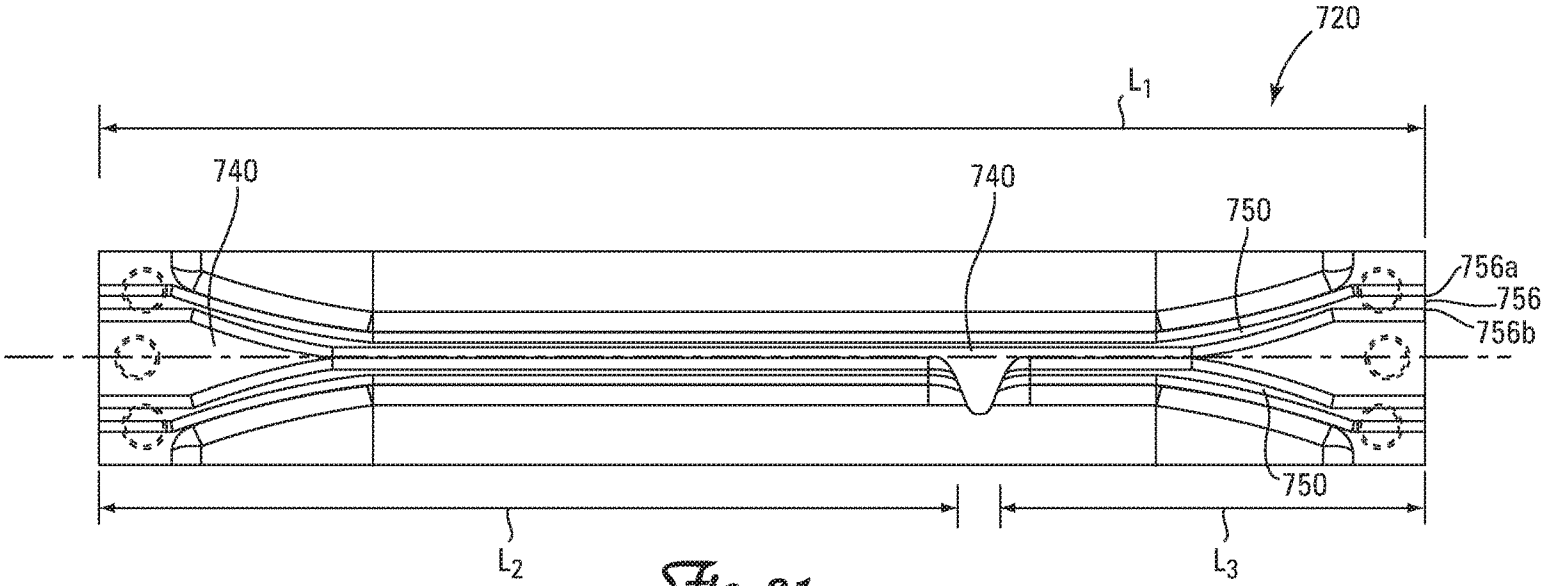
FIG. 21 is a top view of the block splitter assembly of FIG. 20.

FIG. 20 is a side view of a first block splitter assembly 720. FIG. 21 is a top view of the first block splitter assembly 720. First block splitter assembly 720 has first center depression or trough 740 and forming blades 750. Forming blades 750 have planar forming surfaces 756 and forming edges 756*a* and 756*b*. The forming blades 750 have longitudinal lengths $L_1$, $L_2$, and $L_3$, as shown. First block splitter assembly 720 allows the splitting of blocks of varying sizes.

Figure 22:
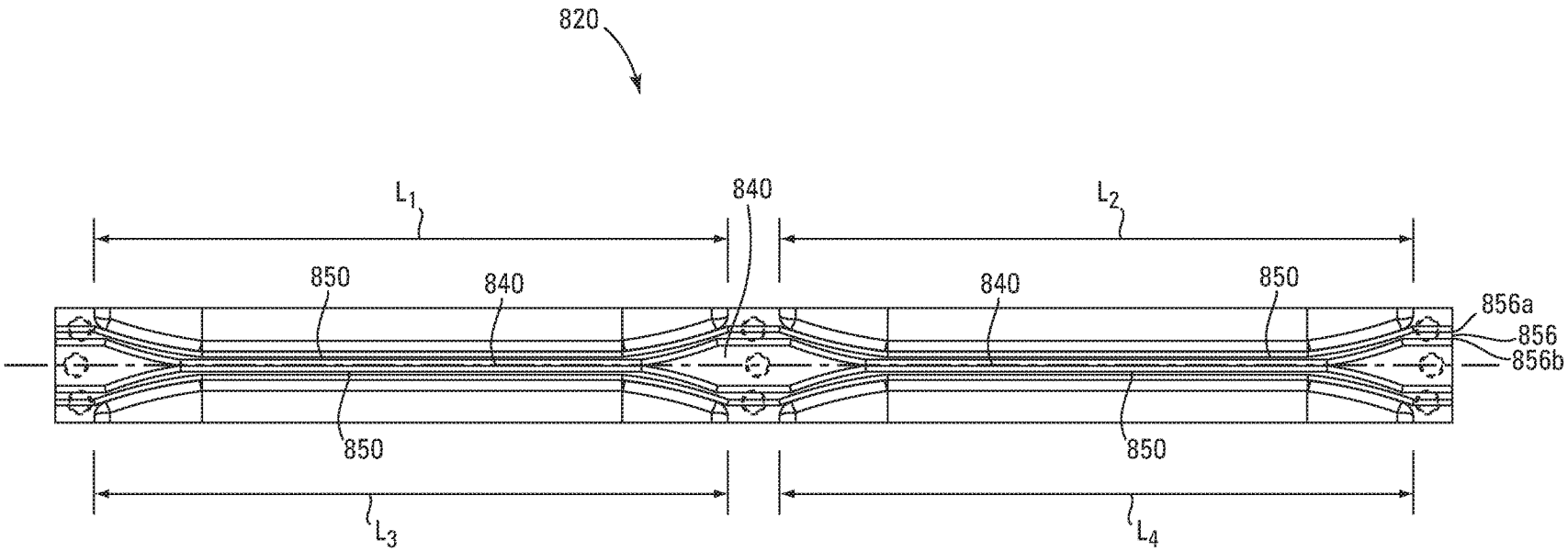
FIG. 22 is a top view of an alternative block splitter assembly.

FIG. 22 is a top view of the first block splitter assembly 820. First block splitter assembly 820 has first center depression or trough 840 and forming blades 850. Forming blades 850 have planar forming surfaces 856 and forming edges 856*a* and 856*b*. The forming blades 850 have longitudinal lengths $L_1$, $L_2$, $L_3$ and $L_4$ as shown. First block splitter assembly 820 produces four blocks each cycle.

Figure 23:
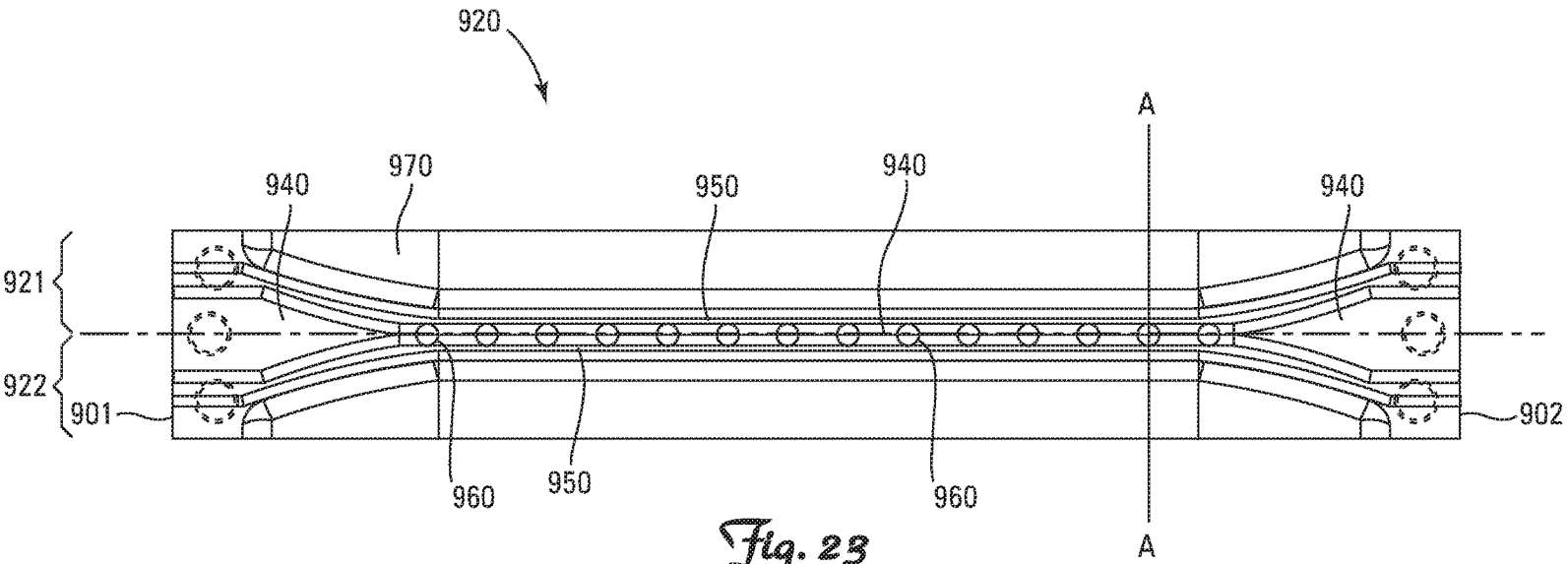
FIGS. 23 and 24 are top and cross-sectional views, respectively, of an alternate block splitter assembly.
Figure 24:
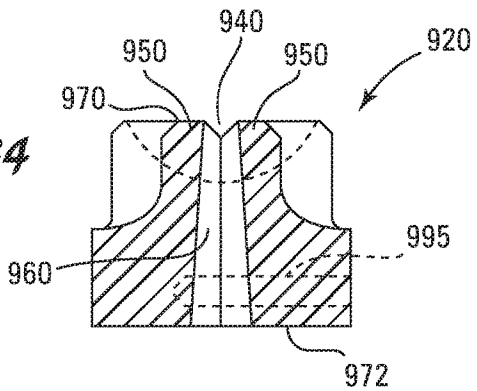

FIGS. 23 and 24 are a top view and a cross sectional side view of block splitter assembly 920. Block splitter assembly 920 has first center depression or trough 940 and forming blades 950. Trough 940 has ported holes 960 that are open from the forming or upper surface 970 to opposed or lower surface 972. Ported holes 960 can help in the removal of excess material that can fill up and clog the trough 940 during the splitting process and negatively affect the aesthetic splitting characteristics and functionality of the product. During the block splitting process, excess or waste material/debris located in trough 940 of bock splitter assembly 920 moves laterally through the slot and block splitter assembly thereby preventing the clogging of the trough 940 with the excess or waste material/debris. As best seen in FIG. 24 that is a cross-sectional view along line A-A of FIG. 23, ported hole 960 may taper outward from the forming or upper surface 970 to opposed or lower surface 972, thus, ported hole 960 may grow in diameter from the forming or upper surface 970 to opposed or lower surface 972. It should be understood that the size, shape and dimensions of ported holes 960 are not limiting and could have any size, shape or dimension as desired and thus ported holes 960 could have substantially vertical walls. Additionally and/or alternatively, block splitter assembly 920 may have a separate first assembly half 921 that may be bolted, screwed or generally affixed to separate second assembly half 922 along a vertical line of symmetry from block splitter assembly end 901 through trough 940 and ported holes 960 to block splitter assembly end 902. Fastening holes 995 allow bolts or screws to fasten the first assembly half 921 to second assembly half 922 during the block splitting process, but could be unbolted or unscrewed to open up the block splitter assembly for cleaning when not in use.

Figure 25:
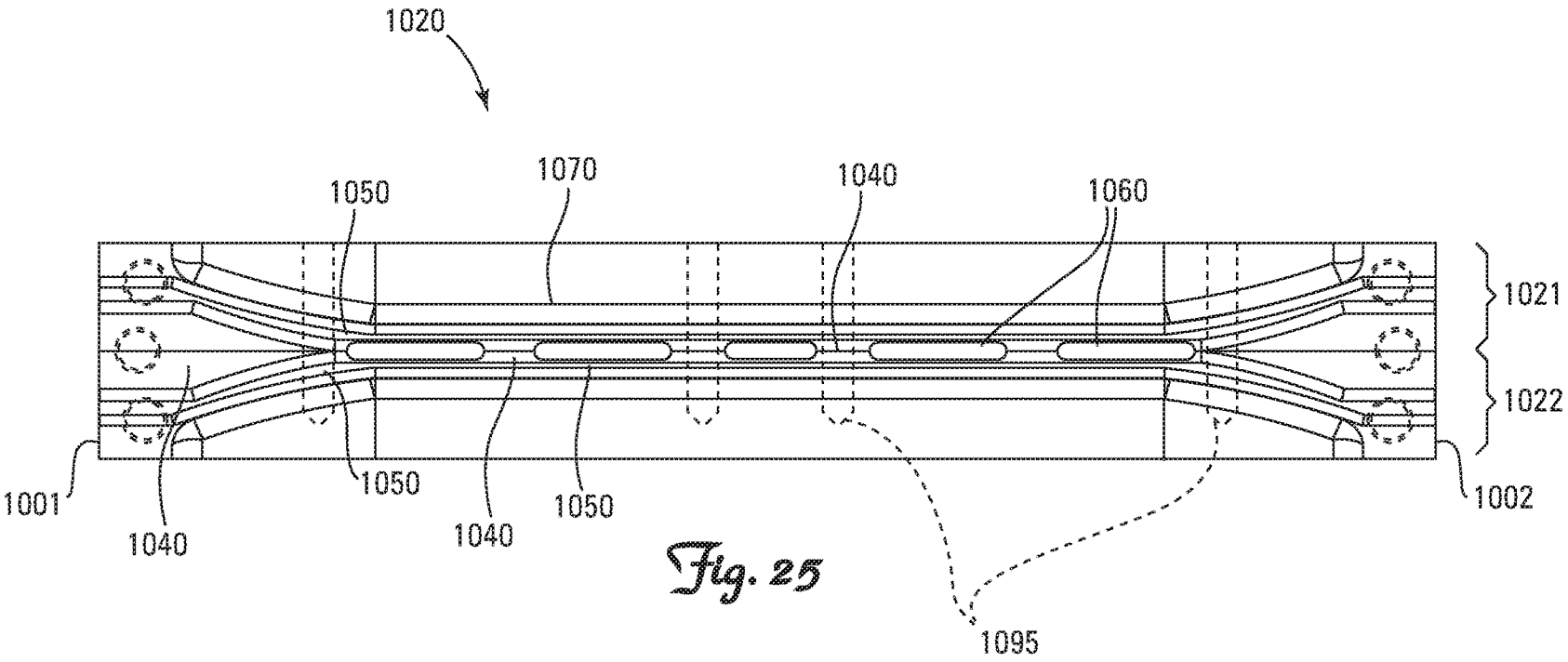
FIG. 25 is a top view of an alternate block splitter assembly.

FIG. 25 is a top view of an alternate embodiment of the block splitter assembly 920 shown with ported slots instead of ported holes. Block splitter assembly 1020 has first center depression or trough 1040 and forming blades 1050. Trough 1040 has ported slots 1060 that are open from the forming or upper surface 1070 to an opposed or lower surface. Ported slots 1060 can help in the removal of excess material that can fill up and clog the trough 1040 during the splitting process and negatively affect the aesthetic splitting characteristics and functionality of the product. Ported slots 1060 may taper outward from the forming or upper surface 1070 to the opposed or lower surface or could have substantially vertical walls. It should be understood that the size, shape and dimensions of ported slots 1060 are not limiting and could have any size, shape or dimension as desired. Additionally and/or alternatively, block splitter assembly 1020 may have a separate first assembly half 1021 that may be bolted, screwed or generally affixed to separate second assembly half 1022 along a vertical line of symmetry from block splitter assembly end 1001 through trough 1040 and ported slots 1060 to block splitter assembly end 1002. Fastening holes 1095 allow bolts or screws to fasten the first assembly half 1021 to second assembly half 1022 during the block splitting process, but could be unbolted or screwed to open up the block splitting assembly for cleaning when not in use.

Figure 26:
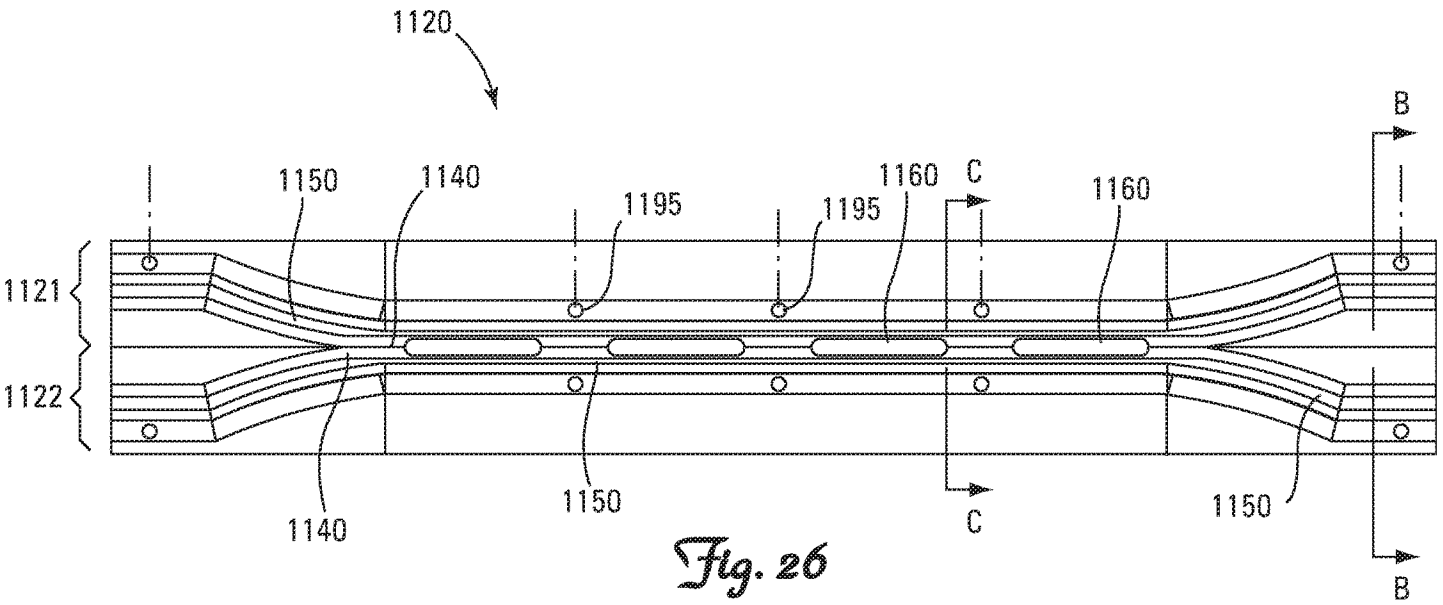
FIGS. 26 to 31 are top, cross-sectional and exploded views, respectively, of an alternate block splitter assembly.
Figure 28:
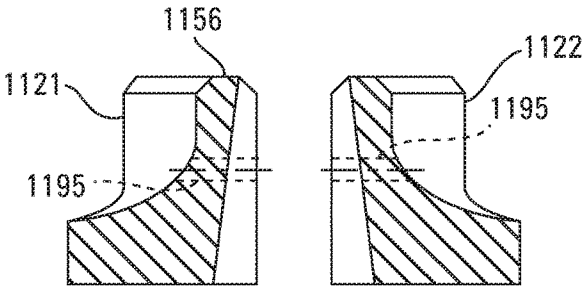
Figure 27:
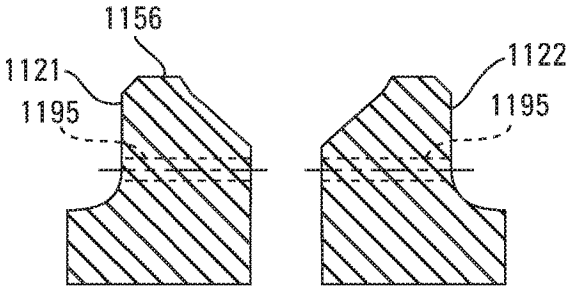
Figure 29:
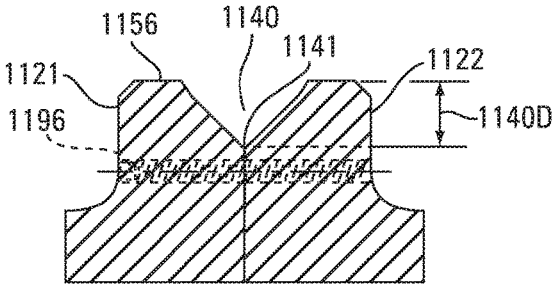
Figure 30:
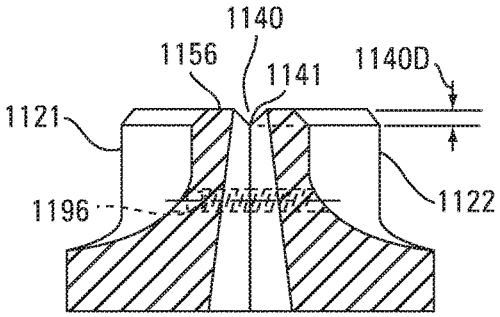

FIG. 26 is a top view of an alternate embodiment 1120 of the block splitter assembly 1020. Block splitter assembly 1120 has ported slots 1160 similar to the ported slots of block splitter assembly 1020, but differing in total number of slots and dimensions of the slots. It should be understood that the slots can have any desired shape or dimension as desired and are shown having rounded ends in FIGS. 25 and 26 and are shown having squared off ends in FIGS. 31 and 32. Block splitter assembly 1120 has a separate first assembly half 1121 that may be bolted, screwed or generally removably affixed to separate second assembly half 1122. As best seen in FIG. 27 and FIG. 28, which are exploded cross-sectional views of block splitter assembly 1120 taken along lines B-B and C-C of FIG. 26 respectively, first assembly half 1121 and second assembly half 1122 have fastening holes 1195 that are configured to align when assembling and securing the first assembly half to the second assembly half. As best seen in FIG. 29 and FIG. 30, which are cross-sectional views of block splitter assembly 1120 taken along lines B-B and C-C of FIG. 26 respectively, the fastening holes 1195 accept and allow bolts, screws or other securing means 1196 to fasten and secure the first assembly half 1121 to second assembly half 1122 for use during the block splitting process. Securing means 1196 can additionally be unbolted, unscrewed or generally removed to separate first assembly half 1121 and second assembly half 1122 of the block splitter assembly for cleaning and removal of any lodged material.

Figure 31:
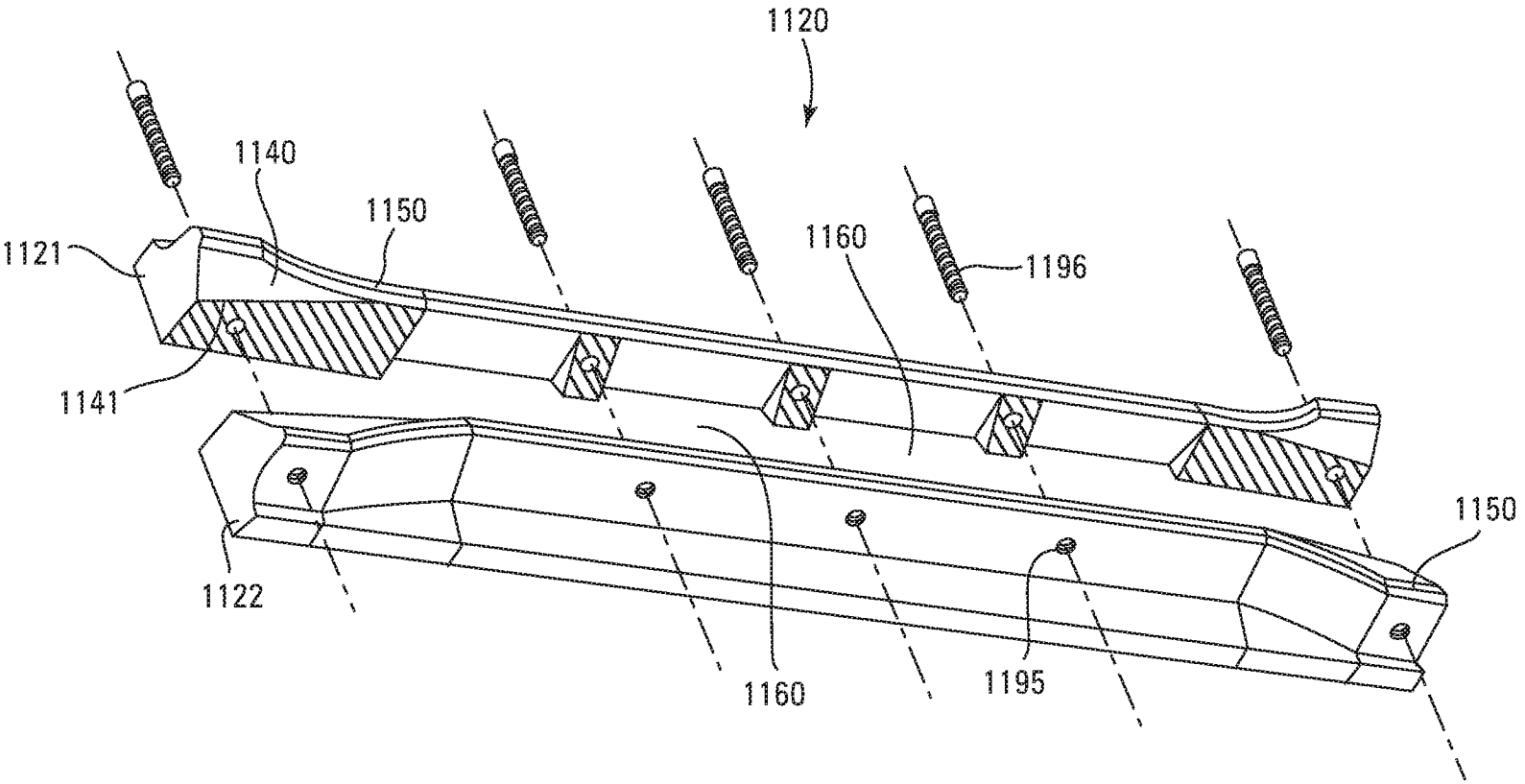

Block splitter assembly 1120 has central depression or trough 1140. As best seen in the exploded view of FIG. 31, central depression 1140 is the location of the bisection line of block splitter assembly 1120 where first assembly half 1121 separates or connects to second assembly half 1122. Central trough 1140 has varying width as measured from the forming blade 1150 of first assembly half 1121 to the forming blade 1150 of the second assembly half when the first assembly half is secured to the second assembly half. Central trough 1140 may also have a varying depth 1140D as measured from forming surface 1156 of forming blades 1150 to lower surface 1141 of the central depression 1140. As can be seen in FIGS. 29 to 31, depth 1140D of central depression 1140 is greater toward the ends of the block splitter assembly than towards the center of the block splitter assembly. As such, central depression 1140 has an angular descending slope from center portion 1162 towards block splitter assembly ends 1101 and 1102. Depth 1140D could have a constant depth along center portion 1162 where forming blades 1150 are parallel to one another and could have a an increasing depth where forming blades 1150 begin to flare, taper or curve away from each other. The increasing depth could continue from the taper to the ends of the block splitter assembly 1120. The angular decreasing slope of central depression 1140 allows gravity to carry excess material or debris that may build up during the block splitting process away from the forming blades and out of the block splitting device, thus increasing the functionality and performance of the block splitter assembly 1120 and the block splitter device. It should be understood that the angular descending slope of central trough 1140 is not limiting and could have any desired degree of slope. Additionally, it is to be understood that the angular descending slope could begin at any desired location along the length of the central trough 1140. It should be further understood that the angular descending slope of central trough 1140 could be applied to any embodiment of the block splitter assembly described herein.

Figure 32:
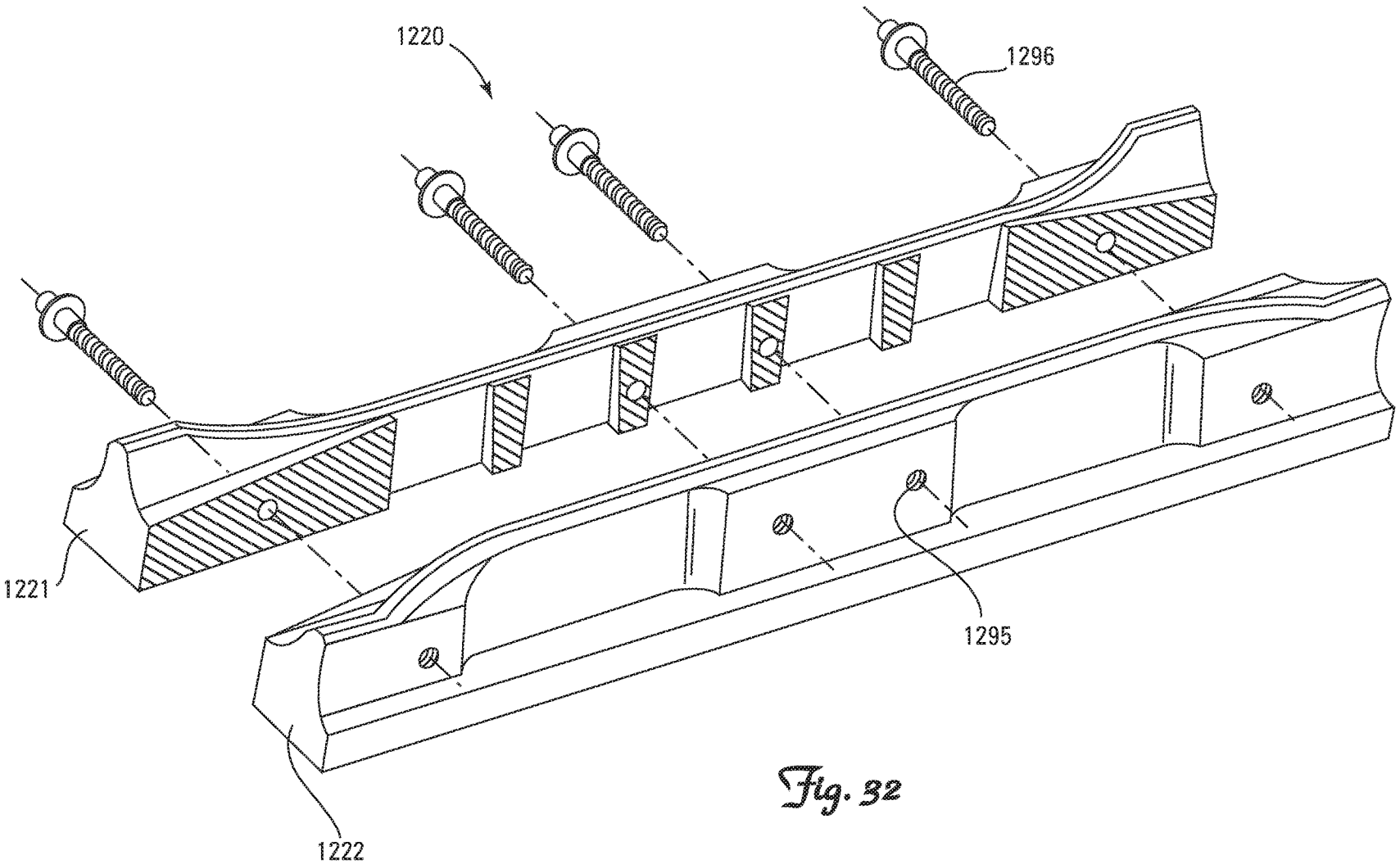
FIG. 32 is an exploded view of an alternate block splitter assembly.

FIG. 32 is an exploded view of alternate splitter blade assembly 1220. Splitter blade assembly is substantially similar to splitter blade assembly 1120 except that additional reinforcement has been given around fastening holes 1295 to add further structural support for securing the first assembly half 1221 to second assembly half 1222. As shown in FIG. 32 the side walls of the first and second assembly halves 1221 and 1222 have been increased at the locations where the fastening holes are positioned thereby increasing the length of the fastening hole and the length of the bolt, screw or other fastening means 1296 needed to affix the first assembly half to the second assembly half. Additionally or alternatively, the width or diameter of the fastening hole and thereby the fastening means may also be increased for further support.

Although particular embodiments have been disclosed herein in detail, this has been done for purposes of illustration only, and is not intended to be limiting with respect to the scope of the following appended claims. In particular, it is contemplated by the inventors that various substitutions, alterations, and modifications may be made to the invention without departing from the spirit and scope of the invention as defined by the claims. For instance, the choices of materials or variations in shapes are believed to be a matter of routine for a person of ordinary skill in the art with knowledge of the embodiments disclosed herein.

What is claimed is:

1. A block splitter device comprising first lower and second upper opposed block splitter assemblies, the first block splitter assembly having a first end opposed from a second end, a first side surface opposed from a second side surface, a bottom surface, a central depression and exactly two first forming blades, the central depression extending the length of the first block splitter assembly as measured from the first end to the second end, one of the first forming blades being disposed to the right of and one of the first forming blades being disposed to the left of the central depression, the two first forming blades each having a single forming surface, each forming surface being horizontally planar and having first and second forming edges, each forming surface having a lateral width as measured from the first forming edge to the second forming edge, the lateral width of each forming surface having a larger dimension at the ends of the first block splitter assembly than towards the center of the first block splitter assembly, the second block splitter assembly having a first end opposed from a second end, a first side surface opposed from a second side surface, an upper surface, a central depression and exactly two second forming blades, the central depression extending the length of the second block splitter assembly as measured from the first end to the second end, one of the second forming blades being disposed to the right of and one of the second forming blades being disposed to the left of the central depression, the two second forming blades each having a single forming surface, each forming surface being horizontally planar and having first and second forming edges, each forming surface having a lateral width as measured from the first forming edge to the second forming edge, the lateral width of each forming surface having a larger dimension at the ends of the first block splitter assembly than towards the center of the first block splitter assembly, and the forming surfaces of the forming blades of the first block splitter assembly being opposed to the forming surfaces of the forming blades of the second block splitter assembly.

2. The block splitter device of claim 1, wherein one of the first forming blades is parallel to the other of the first forming blades for at least a portion of the length of the first block splitter assembly and wherein one of the second forming blades is parallel to the other of the second forming blades for at least a portion of the length of the second block splitter assembly.

3. The block splitter device of claim 1, wherein one of the first forming blades is parallel to the other of the first forming blades for at least one portion of the length of the first block splitter assembly and one of the first forming blades is non-parallel to the other of the first forming blades for at least one portion of the length of the first block splitter assembly and wherein one of the second forming blades is parallel to the other of the second forming blades for at least one portion of the length of the second block splitter assembly and one of the second forming blades is non-parallel to the other of the second forming blades for at least one portion of the length of the second block splitter assembly.

4. The block splitter device of claim 1, wherein one of the first forming blades is parallel to the other of the first forming blades for at least two non-consecutive portions of the lengths of each first forming blade and wherein one of the second forming blades is parallel to the other of the second forming blades for at least two non-consecutive portions of the lengths of each second forming blade.

5. The block splitter device of claim 4, wherein one of the first forming blades is non-parallel to the other of the first forming blades for at least two non-consecutive portions of the lengths of each first forming blade and wherein one of the second forming blades is non-parallel to the other of the second forming blades for at least two non-consecutive portions of the lengths of each second forming blade.

6. The block splitter device of claim 1, wherein the lateral width of each of the forming surfaces have the same dimension for at least a portion of the lengths of the first forming blades and wherein the lateral width of each of the forming surfaces have the same dimension for at least a portion of the lengths of the second forming blades.

7. The block splitter device of claim 1, wherein the lateral width of each of the forming surfaces has more than two different dimensions along the lengths of the first forming blades and wherein the lateral width of each of the forming surfaces has more than two different dimensions along the lengths of the second forming blades.

8. The block splitter device of claim 1, wherein each of the second forming edges of the first forming blades are adjacent the central depression of the first block splitter assembly and each of the second forming edges of the second forming blades are adjacent the central depression of the second block splitter assembly and wherein the central depression of the first block splitter assembly has a lateral width as measured from the second forming edge of one of the first forming blades to the second forming edge of the other of the first forming blades and the central depression of the second block splitter assembly has a lateral width as measured from the second forming edge of one of the second forming blades to the second forming edge of the other of the second forming blades and wherein the lateral width of the central depression of the first block splitter assembly and the second block splitter assembly is greater towards the ends of the central depression than towards a mid-point of the central depression.

9. The block splitter device of claim 8, wherein the lateral width of the central depression of the first block splitter assembly has more than two different dimensions along the length of the first block splitter assembly and wherein the lateral width of the central depression of the second block splitter assembly has more than two different dimensions along the length of the second block splitter assembly.

10. The block splitter device of claim 8 wherein the central depression of the first block splitter assembly has at least one opening extending from a lower surface of the central depression toward the lower surface of the first block splitter assembly.

11. The block splitter device of claim 10 wherein the at least one opening has side walls and wherein the side walls taper outward from the lower surface of the central depression toward the lower surface of the block splitter assembly.

12. The block splitter device of claim 1 wherein the central depression of the first block splitter assembly has a depth as measured from the upper surface of the forming blade to the lower surface of the central depression and wherein the depth of the central depression is greater towards the ends of the central depression than towards a mid-point of the central depression.

13. A block splitter device comprising a block splitter assembly having a first end opposed from a second end, a first side surface opposed from a second side surface, a planar surface, a central depression and exactly two forming blades, the central depression extending a length of the block splitter assembly as measured from the first end to the second end, one of the forming blades being disposed to the right of and one of the forming blades being disposed to the left of the central depression, the two forming blades each having a single forming surface, each forming surface being horizontally planar and opposed to the planar surface, each forming surface having first and second forming edges and a lateral width as measured from the first forming edge to the second forming edge, the lateral width of each forming surface having a larger dimension at the ends of the block splitter assembly than towards the center of the block splitter assembly.

14. The block splitter device of claim 13, wherein each of the second forming edges of the forming blades are adjacent the central depression of the block splitter assembly and wherein the central depression of the block splitter assembly has a lateral width as measured from the second forming edge of one of the forming blades to the second forming edge of the other of the forming blades and wherein the lateral width of the central depression of the block splitter assembly is greater towards the ends of the central depression than towards a mid-point of the central depression.

15. The block splitter device of claim 13 wherein the central depression of the first block splitter assembly has at least one opening extending from the surface of the central depression toward the planar surface of the block splitter assembly.

16. The block splitter device of claim 13 wherein the central depression of the first block splitter assembly has a depth as measured from the forming surface of the forming blade to the surface of the central depression and wherein the depth of the central depression is greater towards the ends of the central depression than towards a mid-point of the central depression.

17. A method of producing a concrete block comprising:

(i) providing a block splitter device comprising first lower and second upper opposed splitter blade assemblies, the first block splitter assembly having a first end opposed from a second end, a first side surface opposed from a second side surface, a bottom surface, a central depression and exactly two first forming blades, the central depression extending the length of the first block splitter assembly as measured from the first end to the second end, one of the first forming blades being disposed to the right of and one of the first forming blades being disposed to the left of the central depression, the two first forming blades each having a single forming surface, each forming surface being horizontally planar and having first and second forming edges, each forming surface having a lateral width as measured from the first forming edge to the second forming edge, the lateral width of each forming surface having a larger dimension at the ends of the first block splitter assembly than towards the center of the first block splitter assembly, the second block splitter assembly having a first end opposed from a second end, a first side surface opposed from a second side surface, an upper surface, a central depression and exactly two second forming blades, the central depression extending the length of the second block splitter assembly as measured from the first end to the second end, one of the second forming blades being disposed to the right of and one of the second forming blades being disposed to the left of the central depression, the two second forming blades each having a single forming surface, each forming surface being horizontally planar and having first and second forming edges, each forming surface having a lateral width as measured from the first forming edge to the second forming edge, the lateral width of each forming surface having a larger dimension at the ends of the second block splitter assembly than towards the center of the second block splitter assembly, and the forming surface of the first block splitter assembly being opposed to the forming surface of the second block splitter assembly;

(ii) placing a concrete workpiece in the block splitter device at a splitting position to be engaged by the first and second block splitter assemblies; and (iii) with the workpiece at the splitting position, activating the first and second block splitter assemblies to engage the workpiece and thereby split and form the workpiece.

18. The method of claim 17, wherein each of the second forming edges of the first forming blades are adjacent the central depression of the first block splitter assembly and each of the second forming edges of the second forming blades are adjacent the central depression of the second block splitter assembly and wherein the central depression of the first block splitter assembly has a lateral width as measured from the second forming edge of one of the first forming blades to the second forming edge of the other of the first forming blades and the central depression of the second block splitter assembly has a lateral width as measured from the second forming edge of one of the second forming blades to the second forming edge of the other of the second forming blades wherein the lateral width of the central depression of the first block splitter assembly and the second block splitter assembly is greater towards the ends of the central depression than towards a mid-point of the central depression.

19. The method of claim 17 wherein the central depression of the first block splitter assembly has at least one opening extending from a lower surface of the central depression toward the lower surface of the first block splitter assembly.

20. The method of claim 17 wherein the central depression of the first block splitter assembly has a depth as measured from the upper surface of the forming blade to the lower surface of the central depression and wherein the depth of the central depression is greater towards the ends of the central depression than towards a mid-point of the central depression.

* * * * *